US011739980B2

(12) United States Patent
Aoki et al.

(10) Patent No.: US 11,739,980 B2
(45) Date of Patent: Aug. 29, 2023

(54) HEAT EXCHANGING UNIT, HEAT EXCHANGING APPARATUS, AND HOT WATER SUPPLY SYSTEM

(71) Applicant: PURPOSE CO., LTD., Fuji (JP)

(72) Inventors: Toshiaki Aoki, Fuji (JP); Takeharu Totsuka, Fuji (JP); Kyohei Matsushita, Fuji (JP)

(73) Assignee: PURPOSE CO., LTD., Fuji (JP)

( * ) Notice: Subject to any disclaimer, the term of this patent is extended or adjusted under 35 U.S.C. 154(b) by 433 days.

(21) Appl. No.: 16/426,208

(22) Filed: May 30, 2019

(65) Prior Publication Data

US 2020/0064020 A1 Feb. 27, 2020

(30) Foreign Application Priority Data

Aug. 23, 2018 (JP) ..... 2018-155922

(51) Int. Cl.
*F24H 9/00* (2022.01)
*F24H 1/14* (2022.01)
(Continued)

(52) U.S. Cl.
CPC ..... *F24H 1/145* (2013.01); *F24H 8/00* (2013.01); *F24H 9/0031* (2013.01); *F24H 2210/00* (2013.01); *F28D 7/06* (2013.01)

(58) Field of Classification Search
CPC ..... F24H 1/145; F24H 8/00; F24H 2210/00; Y10S 165/409; Y10S 165/352;
(Continued)

(56) References Cited

U.S. PATENT DOCUMENTS 1,769,743 A * 7/1930 Leblanc ..... F28B 1/02 165/145
3,536,060 A * 10/1970 Leo ..... F23M 9/006 126/307 A
(Continued)

FOREIGN PATENT DOCUMENTS

CN 101592402 A 12/2009
JP H07-146003 A 6/1995
(Continued)

OTHER PUBLICATIONS

JP-2017083048-A machine translation (Year: 2022).*
(Continued)

*Primary Examiner* — Michael G Hoang
*Assistant Examiner* — Andrew W Cheung
(74) *Attorney, Agent, or Firm* — WHDA, LLP

(57) ABSTRACT

A heat exchanging unit exchanges heat between a fluid to be heated and exhaust gas. The heat exchanging unit includes a heat exchange portion, a header portion, and a flow changing portion. The heat exchange portion includes a heat exchange pipe in the interior of which the fluid to be heated flows. The header portion is connected to the heat exchange pipe, the header portion allowing the fluid to be heated to flow from the header portion to the heat exchange pipe or from the heat exchange pipe to the header portion. The flow changing portion changes the state of flow of the exhaust gas introduced into the heat exchange portion.

14 Claims, 21 Drawing Sheets

(51) Int. Cl.
*F24H 8/00* (2022.01)
*F28D 7/06* (2006.01)

(58) Field of Classification Search
CPC ..... Y10S 165/412; Y10S 165/161; Y10S 165/21; Y10S 165/34; F23M 9/10; F23M 9/06; F28D 1/0475; F28D 7/06; F28D 7/16; F28F 2009/222; F28F 2009/224; F28F 2009/226; F28F 2009/228; F28F 9/22
USPC ..... 392/482; 122/13.01; 165/150
See application file for complete search history.

(56) References Cited

U.S. PATENT DOCUMENTS 3,656,544 A * 4/1972 Howe ..... F28D 7/06 165/74
5,573,061 A * 11/1996 Chiba ..... F28F 9/0202 165/176
7,137,360 B1 * 11/2006 Zorzit ..... F22B 13/04 122/235.11
7,650,933 B2 * 1/2010 Gilbert ..... F28D 7/1615 165/159
8,191,512 B2 * 6/2012 Park ..... F24H 8/00 165/169
10,823,455 B2 * 11/2020 Park ..... F24H 1/41
2007/0227712 A1 * 10/2007 Bugler, III ..... F28D 1/0478 165/172
2009/0288813 A1 11/2009 Park
2012/0312514 A1 * 12/2012 Erickson ..... B21D 53/06 165/163
2013/0000347 A1 * 1/2013 Jin ..... F28D 1/0475 62/498
2014/0245717 A1 * 9/2014 Vuillamy ..... F28F 9/22 60/259
2016/0116228 A1 * 4/2016 Huang ..... F24H 1/145 122/18.2
2017/0045302 A1 * 2/2017 Danov ..... F28F 13/003
2017/0328597 A1 * 11/2017 Miura ..... F24H 1/145
2017/0356691 A1 * 12/2017 Willis ..... F28F 21/086
2018/0087806 A1 * 3/2018 Kondo ..... F28D 9/0043

FOREIGN PATENT DOCUMENTS

JP H07146003 A * 6/1995
JP 2005-274044 A 10/2005
JP 2017-26286 A 2/2017
JP 2017-44437 A 3/2017
JP 2017044437 A * 3/2017
JP 2017-83048 A 5/2017
JP 2017083048 A * 5/2017
JP 2018-4119 A 1/2018

OTHER PUBLICATIONS

JP H07146003 A machine translation (Year: 2022).*
Office Action dated Mar. 1, 2022, issued in counterpart JP application No. 2018-155922, with English Translation. (11 pages).

* cited by examiner

HEAT EXCHANGING UNIT, HEAT EXCHANGING APPARATUS, AND HOT WATER SUPPLY SYSTEM

CROSS-REFERENCE TO RELATED APPLICATIONS

This application is entitled to the benefit of priority of Japanese Patent Application No. 2018-155922, filed on Aug. 23, 2018, the contents of which are hereby incorporated by reference.

BACKGROUND OF THE INVENTION i) Field of the Invention

This disclosure relates to a heat exchange technology that exchanges heat between exhaust gas and a fluid to be heated such as supply water.

ii) Description of the Related Art

A heat exchanger transferring heat of exhaust gas obtained by combustion of a fuel gas to a fluid to be heated includes a primary heat exchanger and a secondary heat exchanger. The primary heat exchanger transfers mainly sensible heat of exhaust gas to the fluid to be heated, while the secondary heat exchanger transfers mainly latent heat of exhaust gas of after primary heat exchange to the fluid to be heated.

The primary heat exchanger and the secondary heat exchanger are arranged upstream and downstream, respectively, of flow of exhaust gas. The fluid to be heated is fed from the secondary heat exchanger to the primary heat exchanger. Due to such a configuration, the secondary heat exchanger subjects mainly latent heat to heat exchange from exhaust gas to a fluid to be heated with a low temperature before heat exchange, after which the primary heat exchanger subjects mainly sensible heat to heat exchange from exhaust gas to the fluid to be heated, thereby enhancing the heat exchange efficiency.

With regard to such a heat exchanger for latent heat recovery, a plurality of heat transfer pipes may be stacked with spacers arranged in gaps in vertical direction between these heat transfer pipes, so that exhaust gas changes its direction so as to bypass the spacers (see, e.g. Japanese Patent Application Laid-Open (JP-A) No. 2018-004119).

In the heat exchanger exchanging heat from exhaust gas to the fluid to be heated such as water, however, there is a problem that the heat exchange efficiency may lower if exhaust gas slips through without being entangled with heat exchange pipes. Specifically, on the secondary heat exchanger side recovering latent heat, if an exhaust passage is widened so as not to increase the exhaust loss of a combustion device, the amount of contact between exhaust gas and the heat exchange pipes reduces, so that enough heat exchange to recover latent heat cannot be performed, which may render the high-efficient heat exchange infeasible. On the other hand, if the heat exchange pipes are arranged densely in the exhaust gas passage, the pressure loss of exhaust gas becomes large, resulting in a problem that flows of exhaust gas may be impeded.

About such problems there is neither disclosure nor suggestion in Japanese Patent Application Laid-Open (JP-A) No. 2018-004119, and furthermore, the configuration disclosed in Japanese Patent Application Laid-Open (JP-A) No. 2018-004119 cannot solve the problems.

BRIEF SUMMARY OF THE INVENTION

It is an object of the present disclosure to achieve an improvement in the heat exchange efficiency without increasing the pressure loss of exhaust gas, for example.

According to an aspect of this disclosure, a heat exchanging unit exchanges heat between a fluid to be heated and exhaust gas. The heat exchanging unit includes a heat exchange portion, a header portion, and a flow changing portion. The heat exchange portion includes a heat exchange pipe allowing the fluid to be heated to flow in the heat exchange pipe. The header portion is connected to the heat exchange pipe, and allows the fluid to be heated to flow from the header portion to the heat exchange pipe or from the heat exchange pipe to the header portion. The flow changing portion changes the state of flow of the exhaust gas introduced into the heat exchange portion.

According to another aspect of this disclosure, a heat exchanging apparatus includes a housing allowing exhaust gas to flow in the housing, and a heat exchanging unit disposed in the housing. The heat exchanging unit includes a heat exchange portion, a header portion and a flow changing portion. The heat exchange portion includes a heat exchange pipe allowing a fluid to be heated to flow in the heat exchange pipe to exchange heat between the fluid to be heated and the exhaust gas. The header portion is connected to the heat exchange pipe to allow the fluid to be heated to flow from the header portion to the heat exchange pipe or from the heat exchange pipe to the header portion. The flow changing portion changes the state of flow of the exhaust gas introduced into the heat exchange portion.

According to yet another aspect of this disclosure, a hot water supply system includes a burner that burns fuel gas to generate exhaust gas, a housing allowing the exhaust gas to flow, and a heat exchanging unit disposed in the housing. The heat exchanging unit includes a heat exchange portion, a header portion and a flow changing portion. The heat exchange portion includes a heat exchange pipe allowing a fluid to be heated to flow in the heat exchange pipe to exchange heat between the fluid to be heated and the exhaust gas. The header portion is connected to the heat exchange pipe to allow the fluid to be heated to flow from the header portion to the heat exchange pipe or from the heat exchange pipe to the header portion. The flow changing portion changes the state of flow of the exhaust gas introduced into the heat exchange portion.

DETAILED DESCRIPTION OF THE INVENTION

First Embodiment

Figure 1:
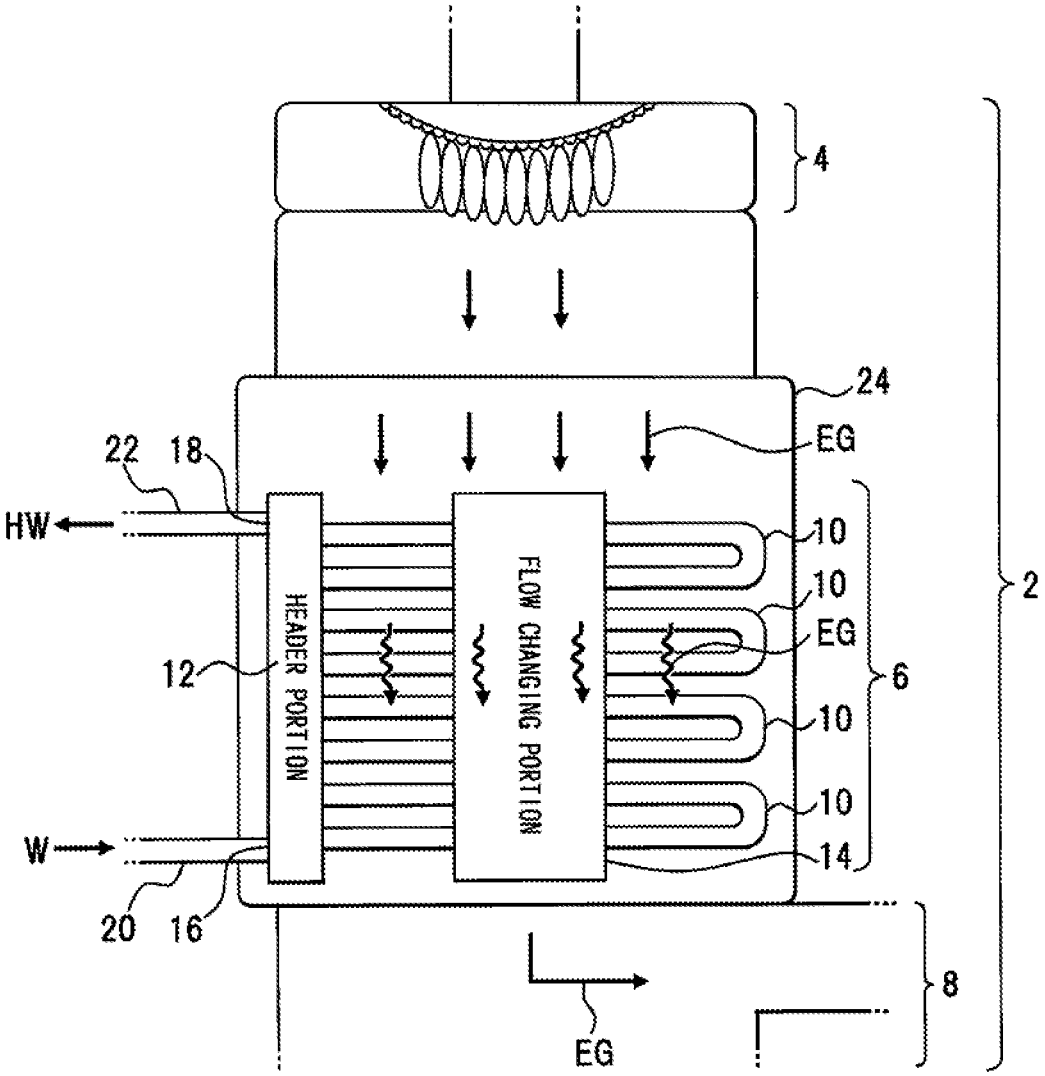
FIG. 1 is a view showing a configuration example of a heat exchanging apparatus according to a first embodiment.

FIG. 1 shows a configuration example of a heat exchanging apparatus according to a first embodiment. The configuration shown in FIG. 1 is an example, and this disclosure is not limited to such a configuration.

This heat exchanging apparatus 2, as shown in FIG. 1, is an example of an apparatus that exchanges heat between a fluid to be heated such as water W and exhaust gas EG, to heat water W through the heat exchange to produce and supply hot water HW. This heat exchanging apparatus 2 includes, for example, a burner 4, a heat exchanging unit 6, and an exhaust portion 8.

The burner 4 is an example of means producing high-temperature exhaust gas EG, and mixes fuel gas and supplied air to burn them. The burner 4 is, for example, a metal knit burner having a metal knit on a combustion surface, and may be another burner. In this metal knit burner, air-fuel mixture fed on the combustion surface generates a flame on a surface of the metal knit to produce exhaust gas EG.

The heat exchanging unit 6 is an example of means exchanging heat between water W and exhaust gas EG that flow through the interior of the heat exchanging unit 6, and includes, for example, a plurality of heat exchange pipes 10, a header portion 12, and a flow changing portion 14. The heat exchanging unit 6 is in communication with the burner 4 through, for example, a single or a plurality of housing(s), piping(s) or a function portion (not shown) of the heat exchanging apparatus 2, and is disposed downstream of the burner 4 in the direction of flow of exhaust gas EG.

The heat exchange pipes 10 are an example of a heat exchange portion of this disclosure, and the heat exchange portion exchanges heat between water W and exhaust gas EG. With water W flowing through the interior of the heat exchange pipes 10, outer peripheral surfaces of the heat exchange pipes 10 are exposed to exhaust gas EG directly or indirectly via members (not shown) so as to allow the heat exchange pipes 10 to exchange heat between water W and exhaust gas EG. The heat exchange pipes 10 are composed of seamless pipes made of corrosion-resistant metal such as stainless steel. Each of the heat exchange pipes 10 includes a bent portion formed at a part of the pipe so that a leading end and a trailing end of the pipe are directed in the same or substantially the same direction. The leading end and the trailing end of the heat exchange pipe 10 are connected to the header portion 12. The heat exchange pipe 10 is, for example, a cylindrical pipe.

The header portion 12 is an example of means that allows the fluid to be heated to flow into the heat exchange pipes 10. For example, the header portion 12 allows water W to flow into some of the heat exchange pipes 10, receives hot water HW heated by the some of the heat exchange pipes 10, and allows the received hot water HW to flow into some of the different heat exchange pipes 10. That is, since water W or hot water HW flows alternately through the header portion 12 and the heat exchange pipes 10, water W or hot water HW is heated by heat exchange in stages. The interior of the header portion 12 is, for example, partitioned on the basis of the connection position and/or the number of a plurality of heat exchange pipes 10 connected to the header portion 12 with a structure that allows water W or hot water HW to flow for each partitioned region. The header portion 12, for example, further includes a water supply portion 16 that receives low-temperature water W from the exterior of the heat exchanging unit 6 and a hot water supply portion 18 that delivers heat-exchanged hot water HW to the exterior of the heat exchanging unit 6. The water supply portion 16 is connected to a water supply pipe 20 leading to a water supply source such as waterworks, for example. The hot water supply portion 18 is connected to a hot water supply pipe 22 leading to another heat exchange portion or a hot water load (not shown), for example.

The heat exchanging unit 6, the water supply pipe 20, and the hot water supply pipe 22 are arranged in a housing portion 24. The housing portion 24, for example, has a space portion in communication with the burner 4 to receive exhaust gas EG.

The flow changing portion 14 is an example of means that changes the state of flow of exhaust gas EG flowing toward the heat exchange pipes 10. This flow changing portion 14 is, for example, formed upstream of the heat exchange pipes 10 or in the vicinity of the heat exchange pipes 10 along the flow direction of exhaust gas EG, and changes the flow state of exhaust gas EG flowing from the burner 4 toward the heat exchange pipes 10. This change in the flow state is a process that allows exhaust gas EG to flow so as to improve the heat exchange efficiency between exhaust gas EG and water W flowing through the interior of the heat exchange pipes 10. For example, the change in the flow state allows flow of exhaust gas EG to become a turbulent flow, not only prolonging the time of contact of exhaust gas EG with the peripheral surfaces of the heat exchange pipes 10, but also increasing the number of times of contact or the area of contact of exhaust gas EG with the heat exchange pipes 10.

Since the flow changing portion 14, for example, only changes flow of exhaust gas EG between a plurality of heat exchange pipes 10 or flow of exhaust gas EG immediately before heat exchange but does not disturb flow of exhaust gas EG discharged from the burner 4 or flow of exhaust gas EG after heat exchange, the state of exhaust flow in the heat exchanging apparatus 2 does not worsen or the influence on exhaust flow in the heat exchanging apparatus 2 is suppressed.

The exhaust portion 8 is an example of means that discharges heat-exchanged exhaust gas EG from the heat exchanging apparatus 2. The exhaust portion 8 may be, for example, connected to an exhaust duct that opens toward a predetermined direction, or may release exhaust gas EG directly into the atmosphere. Exhaust gas EG arriving at the exhaust portion 8 may be in the turbulence state or, in order to increase the exhaust efficiency after heat exchange, may be rectified on the discharge side of the heat exchanging unit 6.

This exhaust portion 8 may include a fan (not shown) for the purpose of enhancing the efficiency of exhaust from the heat exchanging unit 6, for example.

[Heat Exchange Function]

If water W flows through the interior of the plurality of heat exchange pipes 10 arranged in this manner with exhaust gas EG flowing in the form of turbulent flow between the heat exchange pipes 10, the thermal contact distance, during which exhaust gas EG is in thermal contact with water W, is prolonged, so that the time of heat exchange between exhaust gas EG and water W can increase, enabling water W to be heated to hot water HW.

Effects of First Embodiment

According to this embodiment, any one of the following effects can be expected.

(1) Since exhaust gas EG can be entangled with the heat exchange pipes 10, heat of exhaust gas EG can be efficiently transferred through heat exchange to the fluid to be heated such as water W, whereby the heat exchange efficiency of exhaust gas EG can be enhanced.

(2) Since the flow changing portion 14 changes the state of exhaust gas EG into a turbulent flow at a position close to the heat exchange pipes 10, an efficient heat exchange process can be performed before exhaust gas EG is rectified.

(3) Since exhaust gas EG is turned into a turbulent flow immediately before the heat exchange or during the heat exchange, the heat exchange efficiency can be enhanced without affecting the flow state of exhaust gas EG outside of the heat exchanging unit 6.

(4) The improved heat exchange efficiency of exhaust gas EG leads to an improvement in the heating speed of hot water HW up to a predetermined hot water service temperature, with the result that hot water temperature responsiveness to a hot water supply request can be enhanced.

Second Embodiment

Figure 2:
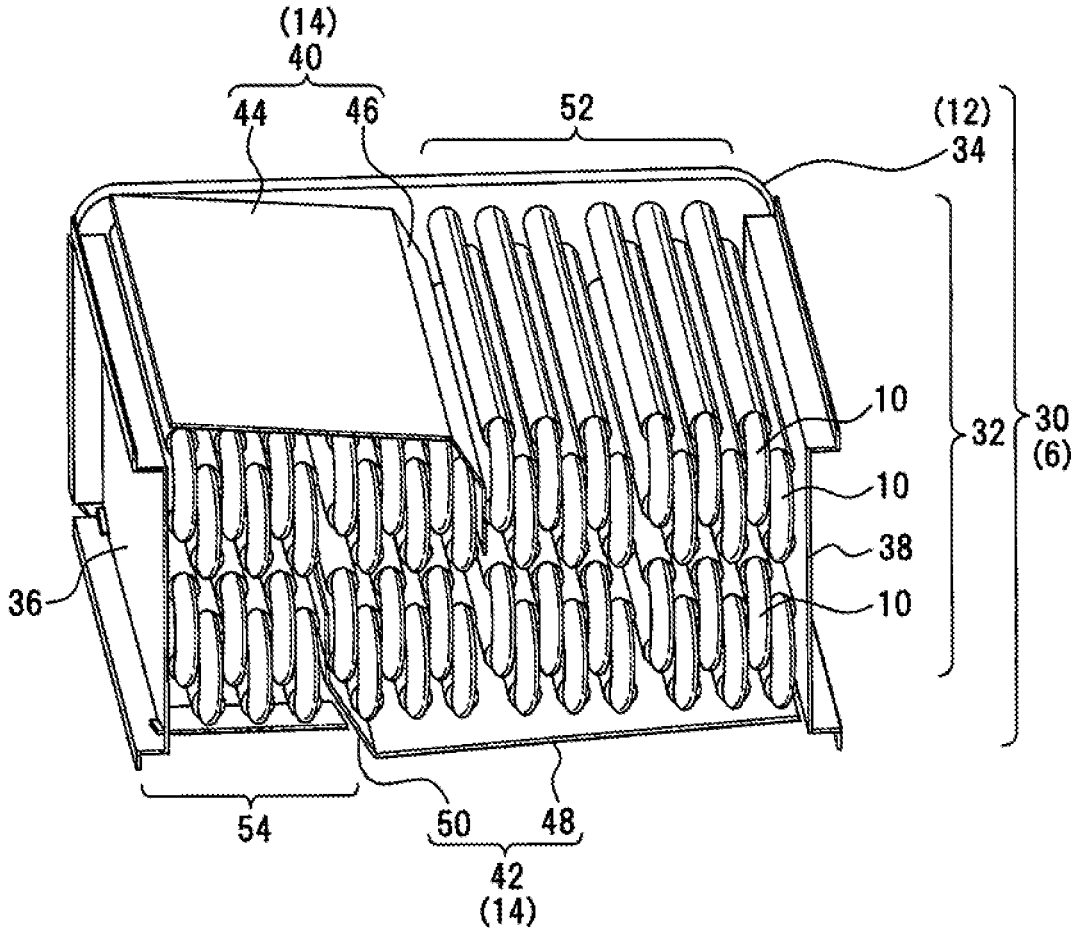
FIG. 2 is a view showing a configuration example of a heat exchanging unit according to a second embodiment.
Figure 3:
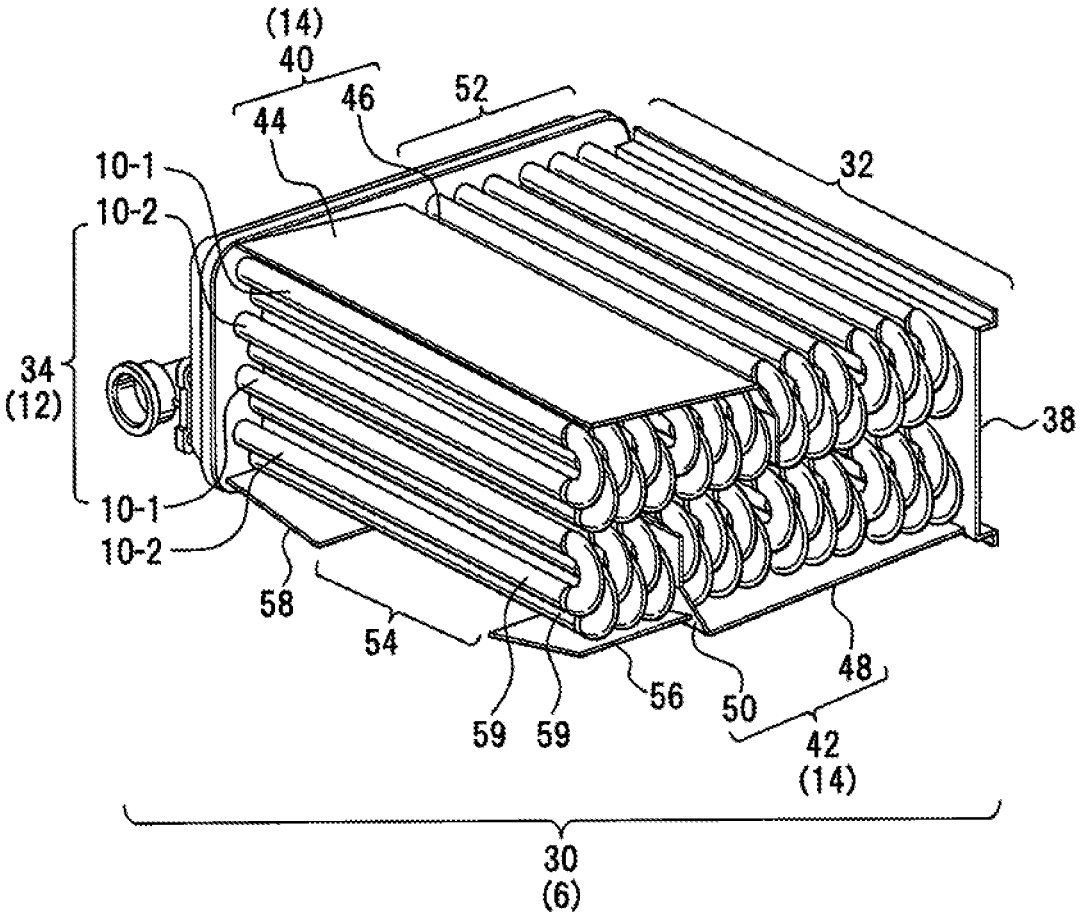
FIG. 3 is a view showing an external configuration example of the heat exchanging unit.
Figure 4:
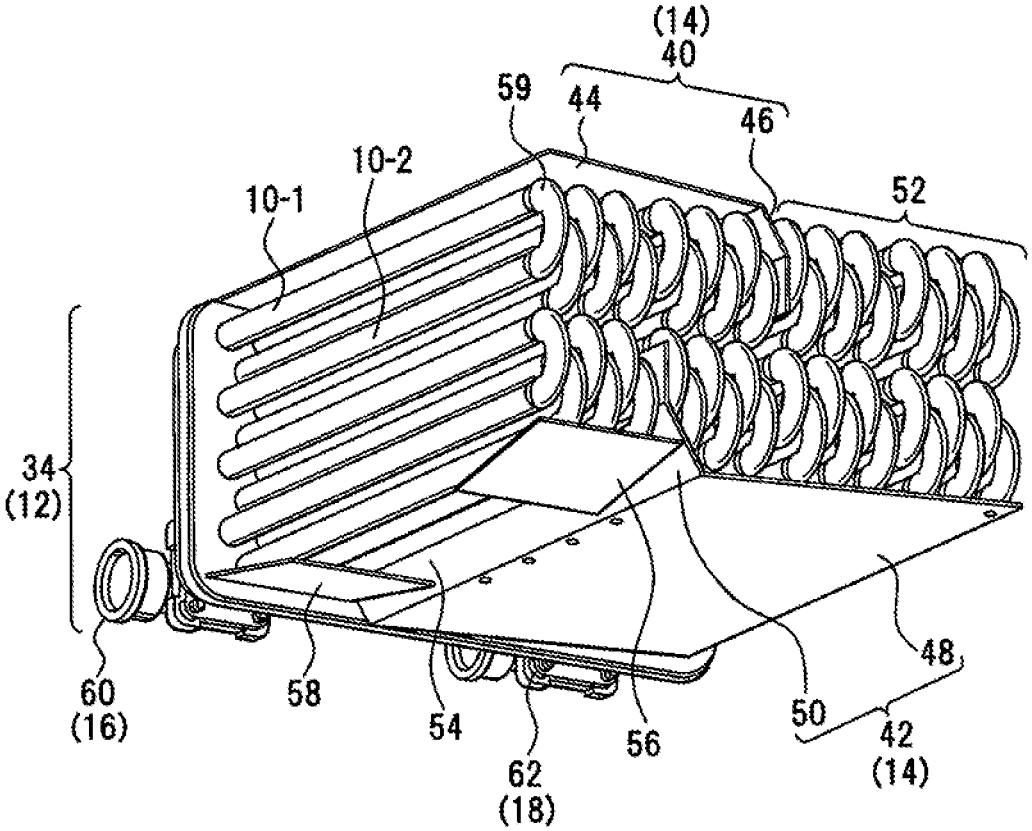
FIG. 4 is a view showing the heat exchanging unit, viewed from an exhaust portion side.

FIG. 2 is a view showing a configuration example of a heat exchanging unit according to a second embodiment. FIG. 3 is a view showing an external example of the heat exchanging unit. FIG. 4 is a view showing the heat exchanging unit, viewed from the exhaust portion side. The configuration shown in FIGS. 2 to 4 is an example and this disclosure is not limited to such configuration.

For example, as shown in FIG. 2, a heat exchanging unit 30 includes a heat exchange portion 32 having a plurality of heat exchange pipes 10, and a header portion 34. The header portion 34 allows a fluid to be heated to flow into a heat exchange pipe 10, receives the fluid to be heated, which is heated by this heat exchange pipe 10, and allows the received fluid to be heated to flow to another heat exchange pipe 10. The heat exchanging unit 30 further includes lateral wall portions 36, 38 and wind direction plates 40, 42. The lateral wall portions 36, 38 prevent exhaust gas EG flowing into the heat exchange portion 32 from being discharged to the exterior of the heat exchange portion 32, while the wind direction plates 40, 42 regulate the flow directions of exhaust gas EG to change the flow state of exhaust gas EG. The wind direction plates 40, 42 form an exhaust flow path through which exhaust gas EG flows. Depending on the locations and shapes of the wind direction plates 40, 42, the exhaust flow path bends flows of exhaust gas flowing through the interior of the heat exchange portion 32 at right angles, at angles approximate right angles, or at angles more than right angles.

The heat exchange portion 32 includes a space through which exhaust gas EG passes, and performs heat exchange by the heat exchange pipes 10 disposed in the space. The heat exchange portion 32 is, for example, partitioned at its right and left ends by the lateral wall portions 36, 38. The heat exchange portion 32 further includes an opening 52 and a discharge portion 54, for example. The opening 52 receives exhaust gas EG from the top side not having the lateral wall portions 36, 38. The discharge portion 54 is disposed at a portion opposite to the opening 52 and discharges exhaust gas EG after heat exchange therefrom.

[About Wind Direction Plate 40]

The wind direction plate 40 is an example of the flow changing portion of this disclosure. The flow changing portion comes into contact with part or all of exhaust gas EG flowing toward the heat exchange portion 32, to change the flow direction of exhaust gas EG. The wind direction plate 40 is disposed on the opening 52 side of the heat exchange portion 32 and switches the direction of flow of exhaust gas EG flowing from a combusting portion such as a burner (not shown), into a direction toward the opening 52. The wind direction plate 40 includes, for example, a cut-off plate 44, and a first regulation plate 46 linked with the cut-off plate 44. The cut-off plate 44 covers some of the heat exchange pipes 10 of the heat exchange portion 32, while the first regulation plate 46 regulates the direction of flow of exhaust gas EG flowing through the interior of the heat exchange portion 32. The cut-off plate 44 prevents some of the heat exchange pipes 10 from coming into direct contact with exhaust gas EG from exterior of the heat exchange portion 32.

For example, a single or a plurality of the first regulation plates 46 may be employed. The cut-off plate 44 and the first regulation plate 46 are fixedly arranged on e.g. a part of the header portion 34 or on a housing (not shown), etc.

This cut-off plate 44 regulates the opening size of the opening 52 and guides a part of exhaust gas EG coming into contact with the cut-off plate 44 toward the opening 52, to change the flow state of exhaust gas EG. As a result, a part of exhaust gas EG, for example, flows toward the opening 52, while another part of exhaust gas EG flows along the cut-off plate 44 to the opening 52.

[About Wind Direction Plate 42]

The wind direction plate 42 is an example of the flow changing portion of this disclosure. The flow changing portion changes the flow state of exhaust gas EG flowing into the heat exchange portion 32. This wind direction plate 42 includes, for example, a disposed cut-off plate 48 confronting the opening 52 of the heat exchange portion 32 and a second regulation plate 50 linked with the cut-off plate 48. The cut-off plate 48 allows exhaust gas EG flowing into the interior of the heat exchange portion 32 to flow toward the center of the heat exchange portion 32, whereas the second regulation plate 50 regulates the direction of flow of exhaust gas EG flowing through the interior of the heat exchange portion 32. A single or a plurality of second regulation plates 50 may be employed. The first and second regulation plates 46, 50 of the wind direction plates 40, 42 confront each other with a predetermined space therebetween in the interior of the heat exchange portion 32. In other words, the wind direction plates 40, 42 form a flow path of exhaust gas EG.

The wind direction plate 42 opens a part of the heat exchange portion 32. This opening portion is the discharge portion 54 that discharges exhaust gas EG after heat exchange flowing through the interior of the heat exchange portion 32.

For example, as shown in FIG. 3, the heat exchanging unit 30 further includes third and fourth regulation plates 56, 58 adjacent to the wind direction plate 42. The third and fourth regulation plates 56, 58 are arranged in the heat exchange portion 32. The third and fourth regulation plates 56, 58 are an example of means that restricts the opening area of the discharge portion 54 of the heat exchange portion 32. The arranged third and fourth regulation plates 56, 58 are tilted at a predetermined angle inward of the heat exchange portion 32, for example. The third and fourth regulation plates 56, 58 are arranged such that, for example, as shown in FIG. 4, exhaust gas EG is collected toward the discharge portion 54.

In addition, the heat exchanging unit 30 includes a water supply portion 60 and a water discharge portion 62 on the header portion 34 side. The water supply portion 60 receives water W as the fluid to be heated before heat exchange from the exterior, whereas the water discharge portion 62 discharges hot water HW after heat exchange.

[About Heat Exchange Pipe 10]

The heat exchange pipe 10 is, for example, a reciprocating pipe with a turn-back portion 59 formed at a midway portion of a conduit. Due to the conduit being bent at 180 degrees or at an angle approximate thereto at the turn-back portion 59, the both ends of the heat exchange pipe 10 are directed in the same direction. The turn-back portion 59 is, for example, a bent portion of a semi-circular shape. Portions of the heat exchange pipe 10 other than the turn-back portion 59, i.e. reciprocating tubular portions are a pair of parallelly-arranged conduit portions 10-1, 10-2, for example. The conduit portions 10-1, 10-2 are straight pipes, for example. A predetermined space is disposed between the conduit portions 10-1, 10-2. For example, the space between the conduit portions 10-1, 10-2 is greater than the diameter of the conduit portions 10-1, 10-2 and is less than twice this diameter.

Similar to the conduit portions 10-1, 10-2, for example, the turn-back portion 59 may have a circular section or a flat section obtained by compressing part thereof.

The length of the conduit portions 10-1, 10-2 is set depending on e.g. the width of the heat exchanging unit 30 or the width of a water heater including the heat exchanging unit 30. Instead of setting the length of the conduit portions 10-1, 10-2, the length of the heat exchange pipe 10 may be set in consideration of, e.g. the efficiency of heat exchange with exhaust gas EG, the water pressure under which the fluid to be heated flows, and the pressure loss of the pipe flow.

Figure 5:
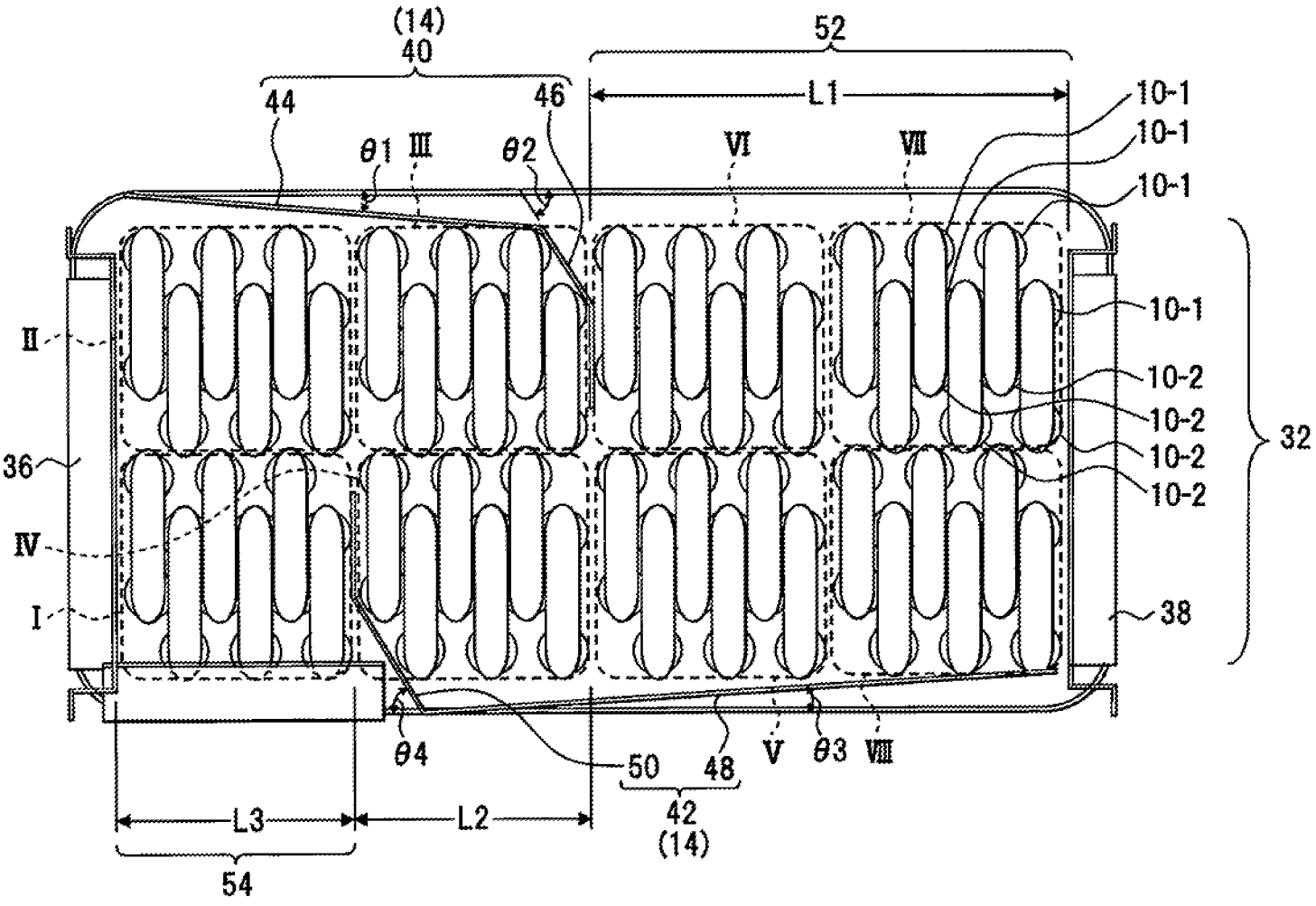
FIG. 5 is a view showing a configuration example of a heat exchange portion side.

In the heat exchange portion 32, for example, as shown in FIG. 5, a plurality of heat exchange pipes 10 are arrayed such that each heat exchange pipe 10 is disposed above or below by a predetermined amount with respect to other heat exchange pipes 10 adjacent transversely. Specifically, the heat exchange pipes 10 are staggered or arranged such that the conduit portion 10-1 or the conduit portion 10-2 of each heat exchange pipe 10 enters into the space between the conduit portions 10-1, 10-2 of adjacent other heat exchange pipe 10. By arranging the heat exchange pipes 10 above or below adjacent other heat exchange pipes 10 in this manner, a space through which exhaust gas EG flows can be formed between the adjacent heat exchange pipes so that more exhaust gas EG can be entangled with the conduit portions 10-1, 10-2. These heat exchange pipes 10 are arranged such that, for example, the space between adjacent heat exchange pipes is less than the diameter of the conduit portions 10-1, 10-2. This heat exchange portion 32 has a plurality of heat exchange pipe groups I to VIII each including a predetermined number of heat exchange pipes 10.

[About Flow Route of Exhaust Gas in Heat Exchange Portion]

The cut-off plate 44 of the wind direction plate 40 is, for example, disposed to be tilted at a predetermined angle θ1 from the horizontal direction toward the interior of the heat exchange portion 32. A part of the first regulation plate 46 at the tip of the cut-off plate 44 is, for example, tilted at a predetermined angle θ2 from the horizontal direction toward the interior of the heat exchange portion 32, and other portions of the first regulation plate 46 is disposed to be further tilted toward the center of the heat exchange portion 32. As a result, the wind direction plate 40 covers the top sides of the heat exchange pipe groups II, III and one lateral side of the heat exchange pipe group III so as to prevent exhaust gas flowing into the heat exchange portion 32 from coming into contact with the heat exchange pipes 10 of the heat exchange pipe groups II, III. By covering one side of the heat exchange pipe groups II, III, the wind direction plate 40 limits an opening width L1 of the opening 52 with respect to the transverse width of the heat exchange portion 32. Since the wind direction plate 40 limits the opening width L1 of the opening 52 of the heat exchange portion 32 in this manner, the flow velocity of exhaust gas EG flowing into the opening 52 increases by Venturi effect, for example.

Exhaust gas EG flowing into the heat exchange portion 32 flows first toward the heat exchange pipe groups VI, VII, V, VIII, to be subjected to heat exchange with fluid to be heated flowing through the interior of the pipes.

The cut-off plate 48 of the wind direction plate 42 is disposed to be tilted at a predetermined angle θ3 from the horizontal direction toward the exterior of the heat exchange portion 32. A part of the second regulation plate 50 at the tip of the cut-off plate 48 is, for example, tilted at a predetermined angle θ4 from the horizontal direction toward the interior of the heat exchange portion 32, and other portions of the second regulation plate 50 is disposed to be further tilted toward the center of the heat exchange portion 32. As a result, the wind direction plate 42 covers the bottom sides of the heat exchange pipe groups IV, V, VIII and one lateral side of the heat exchange pipe group IV.

The heat exchange portion 32 has an exhaust flow path with a predetermined width L2 partitioned by the confronting first and second regulation plates 46, 50 in its interior. Exhaust gas EG flows through the opening 52 into the heat exchange portion 32, a part of exhaust gas EG comes into contact with the cut-off plate 48 of the wind direction plate 42, and other portions is affected by contact with the cut-off plate 48 so that the flow direction of exhaust gas EG is bent at 90 degrees or at an angle approximate thereto. At this time, in the vicinity of the cut-off plate 48, inflow exhaust gas EG mixes with exhaust gas EG whose direction has been changed as a result of contact with the cut-off plate 48, whereupon the flow state of exhaust gas EG becomes a so-called turbulent state.

Exhaust gas EG whose flow direction has been changed by the cut-off plate 48 flows into the heat exchange pipe group IV. At this time, the vicinity of the heat exchange pipe group IV is sandwiched by the first and second regulation plates 46, 50, so that the flow route is narrowed. Exhaust gas EG arriving at the heat exchange pipe group IV flows along the second regulation plate 50, so that the direction of flow of exhaust gas EG is turned upward from the heat exchange pipe group IV. When a part of exhaust gas EG flows from the heat exchange pipe group V through the heat exchange pipe group IV toward the heat exchange pipe group III, at a tip portion of the second regulation plate 50, the direction of flow of a part of exhaust gas EG is, for example, changed rightward at an angle approximate to or not less than 90 degrees. When exhaust gas EG further flows from the heat exchange pipe group IV through the heat exchange pipe group III toward the heat exchange pipe group II, at a tip portion of the first regulation plate 46, the direction of flow of exhaust gas EG is, for example, changed leftward at an angle approximate to or not less than 90 degrees. In this manner, the flow route formed in the heat exchange portion 32 has, for example, a varying flow path width and a cranked shape extending in a transverse direction. Exhaust gas EG passing through such a flow route turns to a turbulent state in its flow state, allowing more exhaust gas EG to become entangled with the peripheries of the heat exchange pipes 10.

[About Configuration of Heat Exchanging Unit 30]

Figure 6:
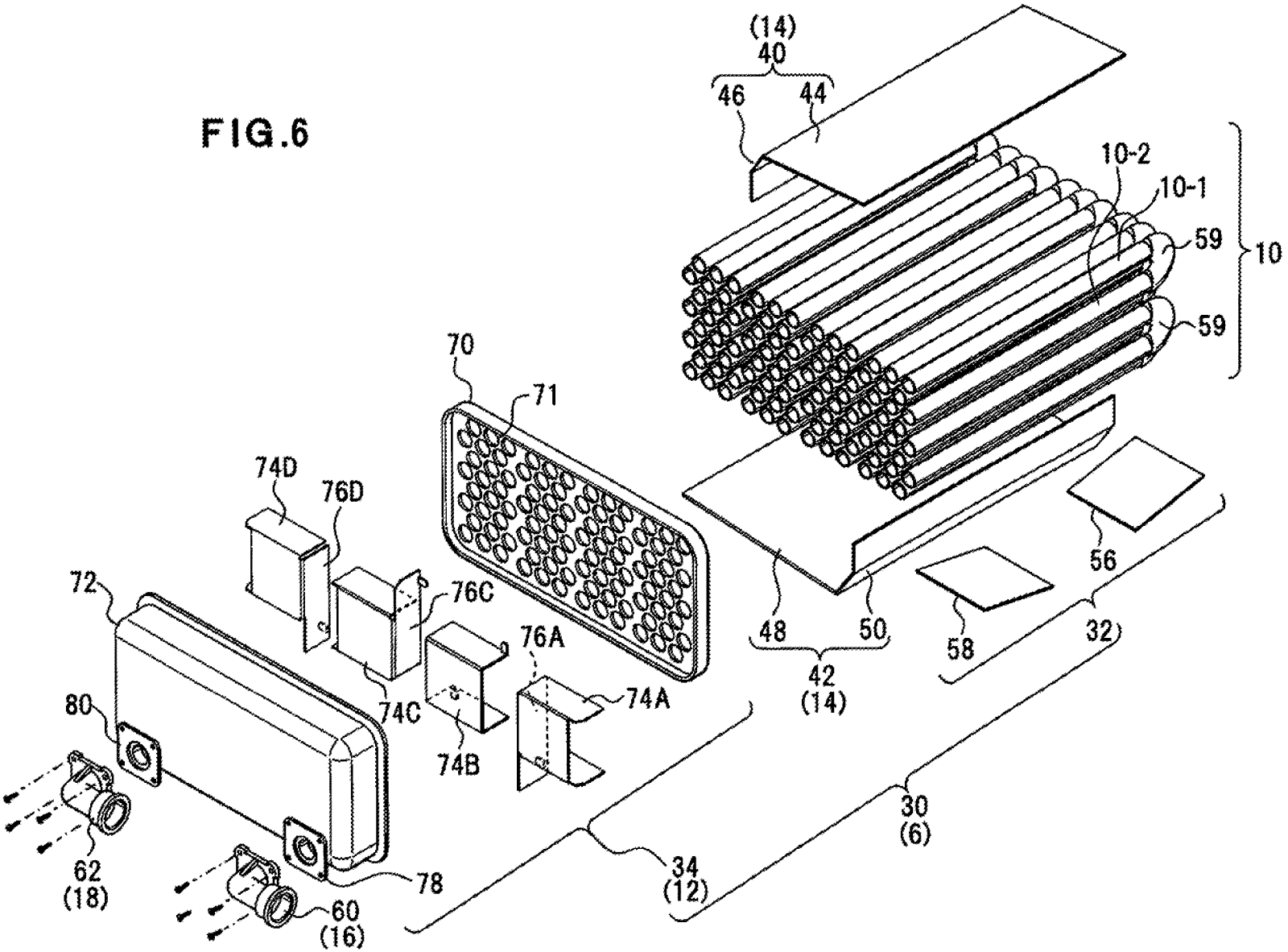
FIG. 6 is an exploded perspective view showing a configuration example of the heat exchanging unit.

FIG. 6 shows a configuration example of the heat exchanging unit.

The header portion 34 includes, as shown in FIG. 6, a heat exchange pipe mounting panel 70, a back panel 72, and a plurality of partition members 74A, 74B, 74C, 74D partitioning the interior of the header portion 34. The heat exchange pipe mounting panel 70 has mounting holes 71 formed on a surface of the heat exchange pipe mounting panel 70, and each mounting hole 71 supports the heat exchange pipe 10 inserted into the mounting hole 71 in a so-called cantilever state. Since either a leading end portion or a trailing end portion of the heat exchange pipe 10 is inserted into each mounting hole 71, the number of mounting holes 71 to be formed doubles in number of the heat exchange pipes 10. The heat exchange pipe mounting panel 70 forms a front surface portion of the header portion 34, for example.

The back panel 72 is a panel member having a C-shaped section that forms a back surface portion, upper and lower surface portions, and right and left lateral surfaces of the header portion 34. This back panel 72 has an inlet port 78 and an outlet port 80. The inlet port 78 receives a fluid to be heated into the header portion 34, while the outlet port 80 discharges the fluid to be heated to the exterior. The inlet port 78 is fixedly connected by a fixing member such as a screw to the water supply portion 60. The outlet port 80 is fixedly connected by the fixing member to the water discharge portion 62. These water supply portion 60 and water discharge portion 62 are connected to conduits (not shown), for example.

The partition members 74A, 74B, 74C, 74D are juxtaposed in the header portion 34 and each have a C-shaped section to enclose front surface and upper and lower surfaces of opening surface of several mounting holes 71 of the heat exchange pipe mounting panel 70. The partition members 74A, 74C, 74D are connected to partition walls 76A, 76C, and 76D, respectively, for example. The partition walls 76A, 76C, 76D are means that partition the interior of the header portion 34 to cut off flows of the fluid to be heated. The partition walls 76A, 76C, 76D may be formed integrally with the partition members 74A, 74C, 74D or may be formed from separate members. Thus, a plurality of chambers are formed in the header portion 34 by these partition members 74A, 74B, 74C, 74D and the partition walls 76A, 76C, 76D.

The partition members 74A, 74B, 74C, 74D are fastened to the heat exchange pipe mounting panel 70, to the back panel 72, or to both the heat exchange pipe mounting panel 70 and the back panel 72, by using e.g. fixing members (not shown), adhesive (not shown), or locking pieces (not shown) formed on the partition members 74A, 74B, 74C, 74D. The partition walls may not necessarily be formed on the partition members 74A, 74C, 74D. The number or the locations of the partition walls or the partition members may differ depending on a set flow route of the fluid to be heated.

[About Chambers Formed in Header Portion 34]

Figure 7:
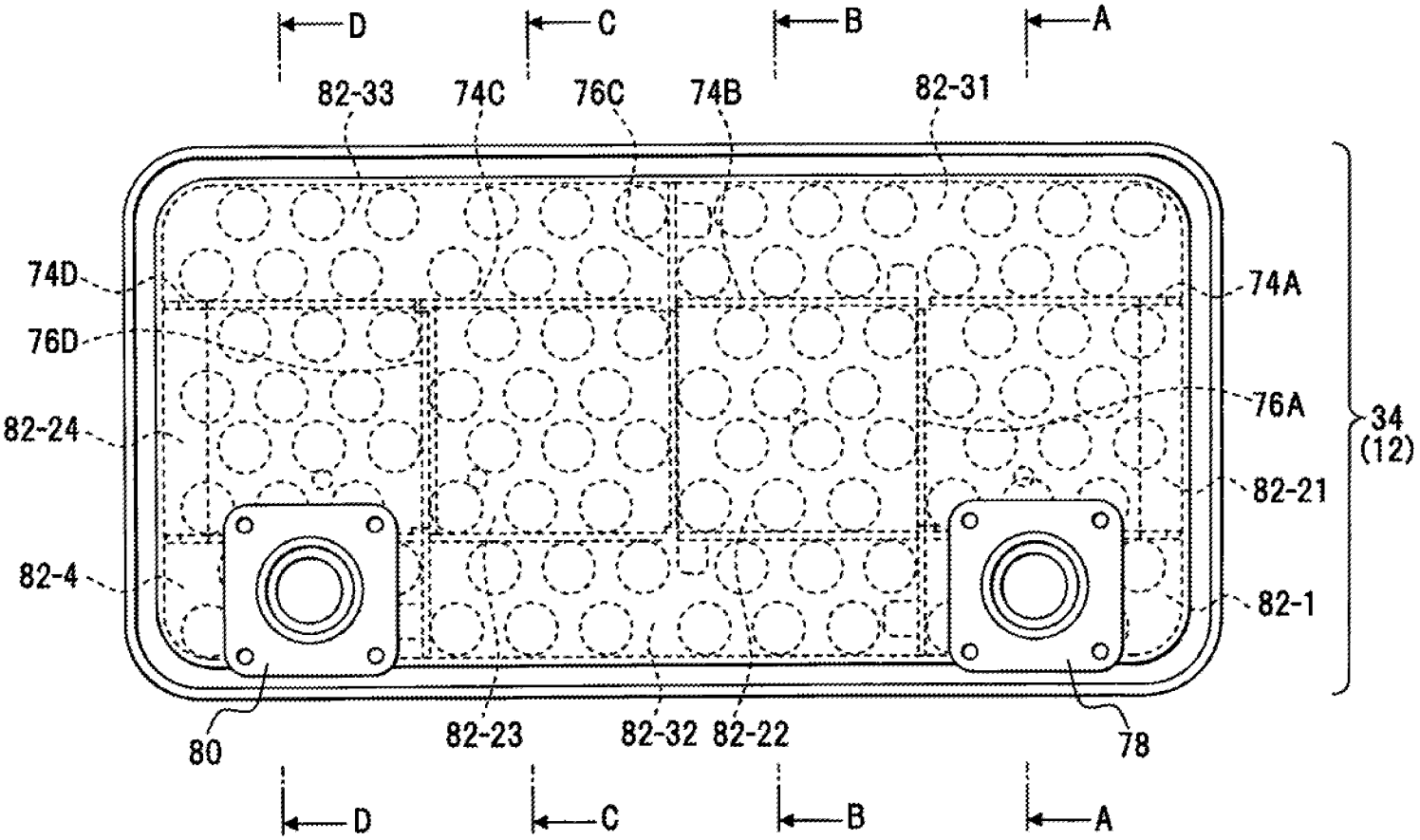
FIG. 7 is a view showing a configuration example of a header portion side.

For example, as shown in FIG. 7, the partition members 74A, 74B, 74C, 74D are transversely arranged in a line in the header portion 34. A plurality of partitioned chambers are formed in the header portion 34, and a water flow path for water W or hot water HW is formed via the heat exchange pipes 10 communicating with the chambers.

The header portion 34 includes, e.g., as a part of the water flow path, an inlet chamber 82-1 and passing chambers 82-21, 82-22, 82-23, 82-24. The inlet chamber 82-1 is a first chamber connected to the inlet port 78 receiving water W. The passing chambers 82-21, 82-22, 82-23, 82-24 are an example of second chambers and allow hot water HW supplied toward a next chamber to pass through. One side and the other side of each of the passing chambers 82-21, 82-22, 82-23, 82-24 adjoin a chamber before supply of water W or hot water HW, and the next chamber, respectively. The header portion 34 further includes turn-back chambers 82-31, 82-32, 82-33 and an outlet chamber 82-4. The turn-back chambers 82-31, 82-32, 82-33 are third chambers. Each of the turn-back chambers 82-31, 82-32, 82-33 allows water W or hot water HW to pass through to turn back the direction of flow of water W or hot water HW for anterior and posterior chambers adjacent on the same side of each of the turn-back chambers 82-31, 82-32, 82-33. The outlet chamber 82-4 is a fourth chamber connected to the outlet port 80 from which hot water HW is discharged.

Figure 8:
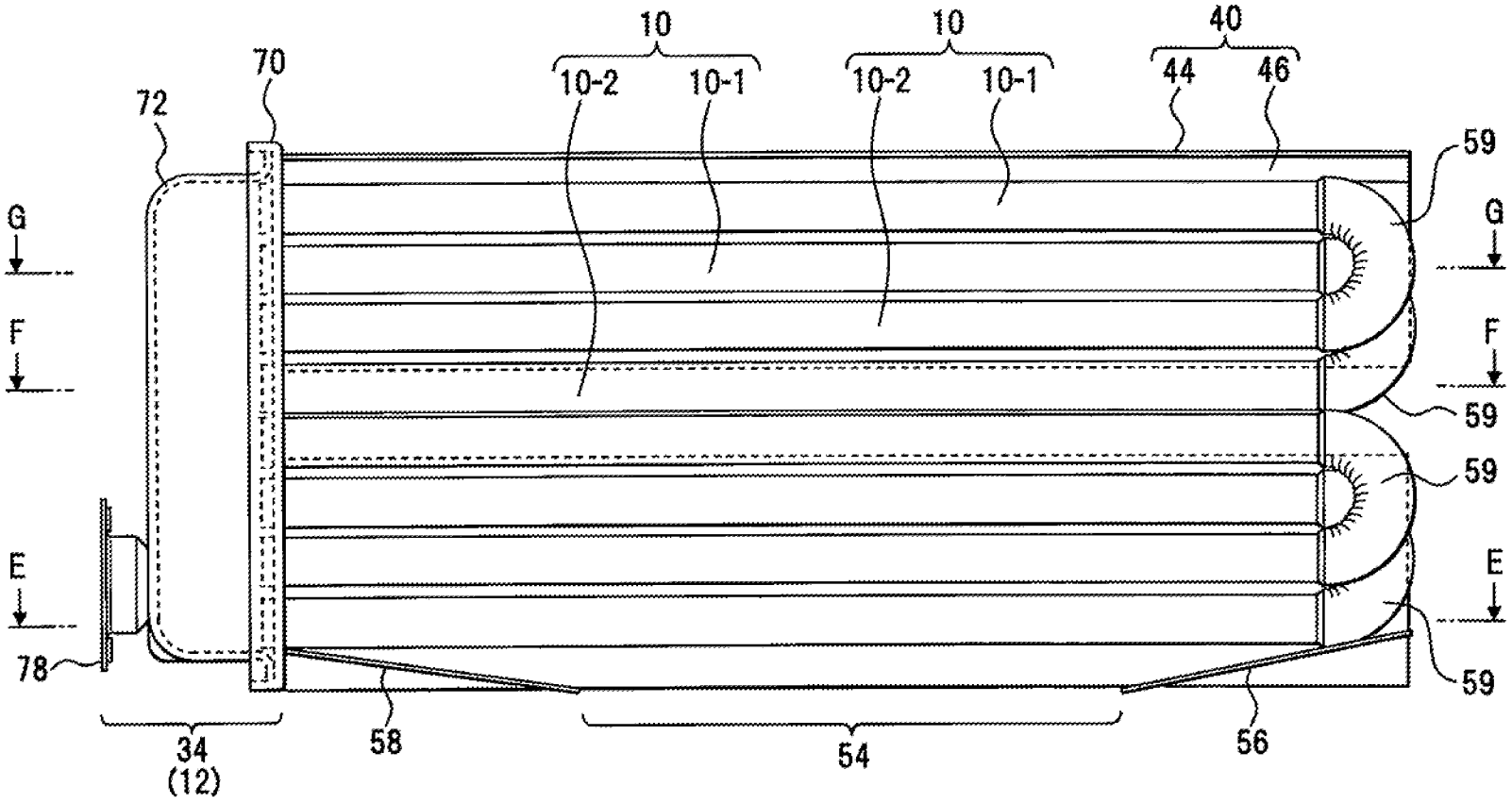
FIG. 8 is a view showing heat exchange pipes, viewed from a lateral surface side.

For example, as shown FIG. 8, the heat exchange pipes 10 are connected to the heat exchange pipe mounting panel 70 of the header portion 34. The conduit portions 10-1, 10-2 of each heat exchange pipe 10 are connected to different chambers formed in the header portion 34. Water W or hot water HW can then flow from one chamber through the heat exchange pipes 10 to the next chamber along the water flow path.

[About Heat Exchange with Water Flow Path and Exhaust Gas EG]

Figure 9:
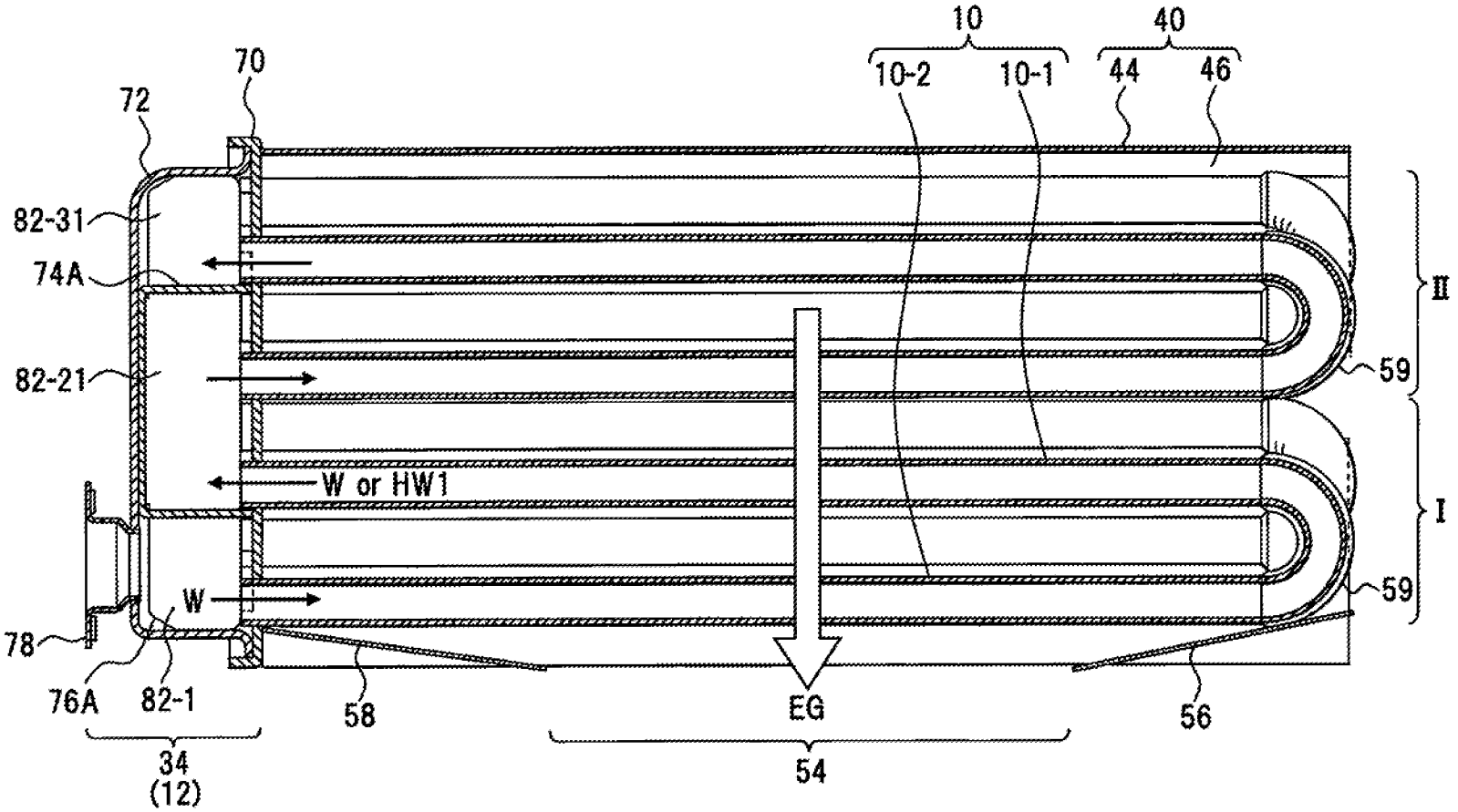
FIG. 9 is a view showing a cross section taken along line A-A of the configuration example of FIG. 7.
Figure 10:
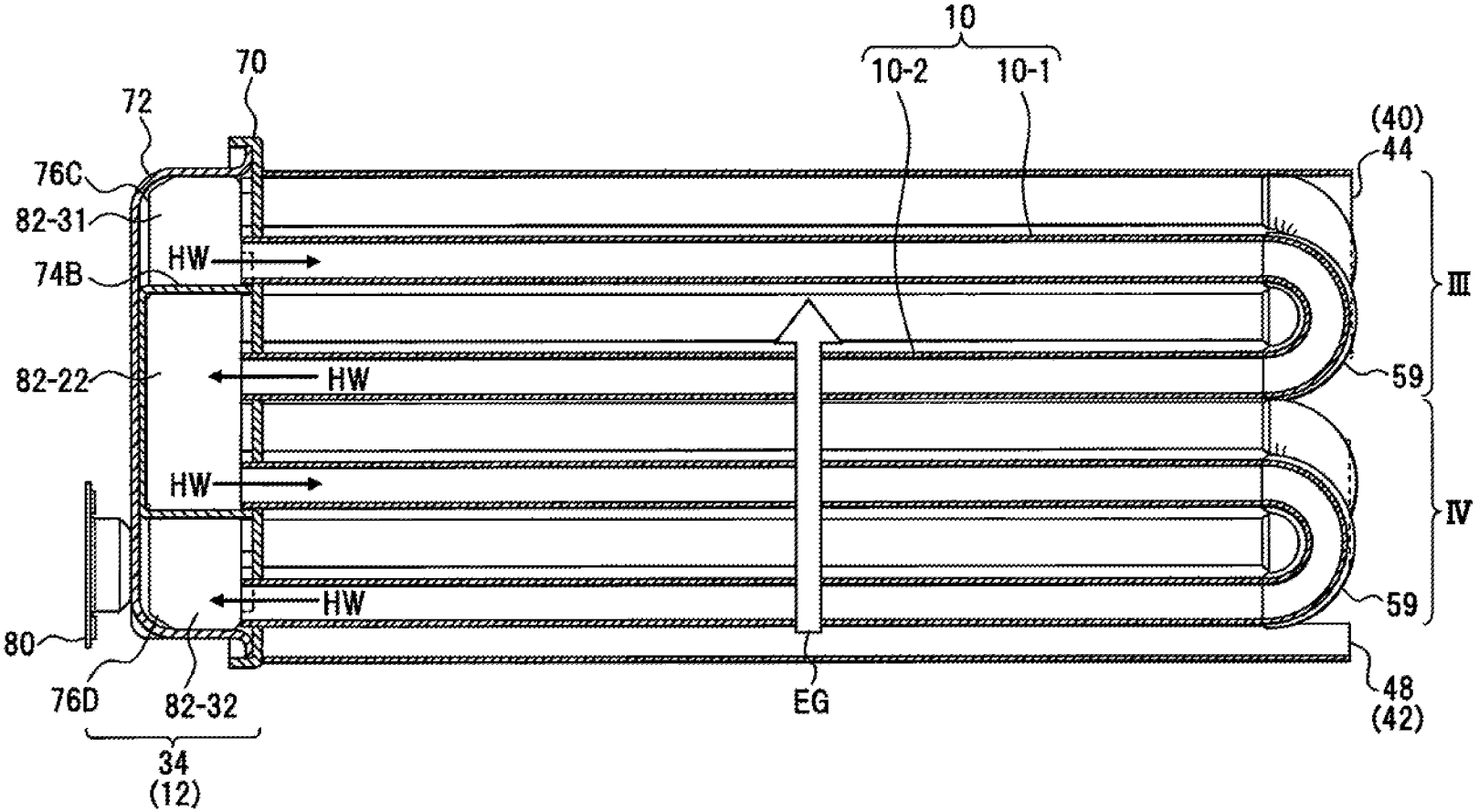
FIG. 10 is a view showing a cross section taken along line B-B of the configuration example of FIG. 7.
Figure 11:
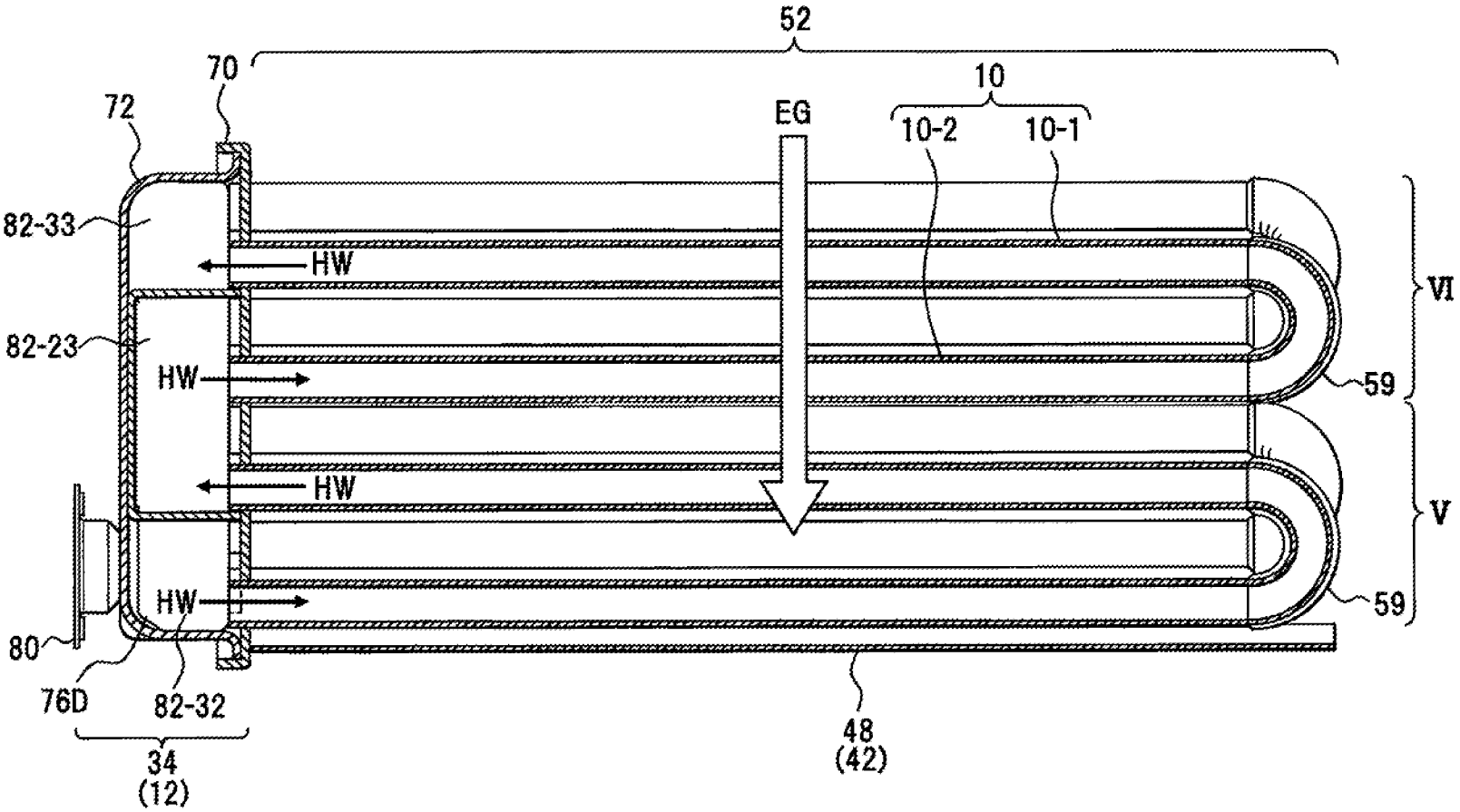
FIG. 11 is a view showing a cross section taken along line C-C of the configuration example of FIG. 7.
Figure 12:
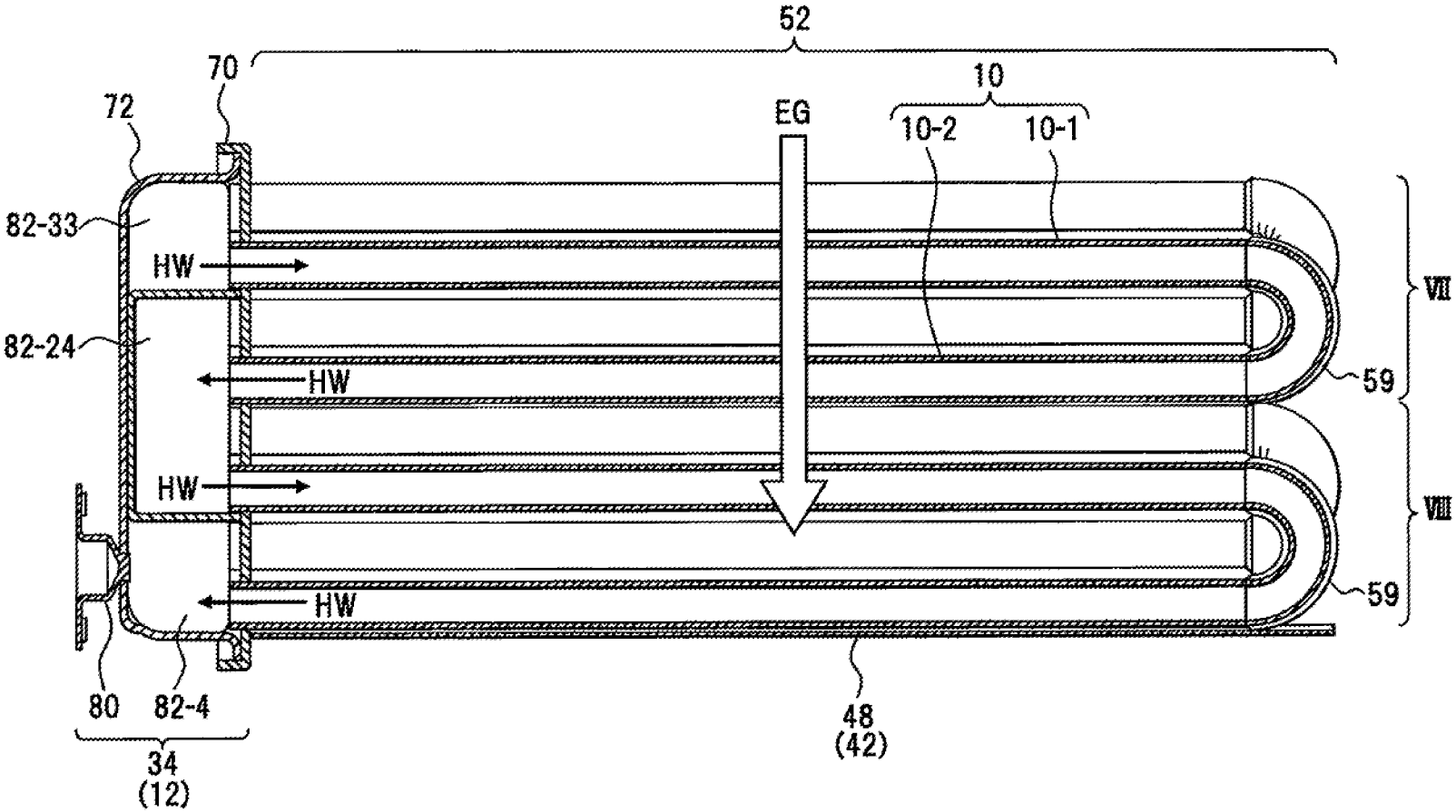
FIG. 12 is a view showing a cross section taken along line D-D of the configuration example of FIG. 7.
Figure 13:
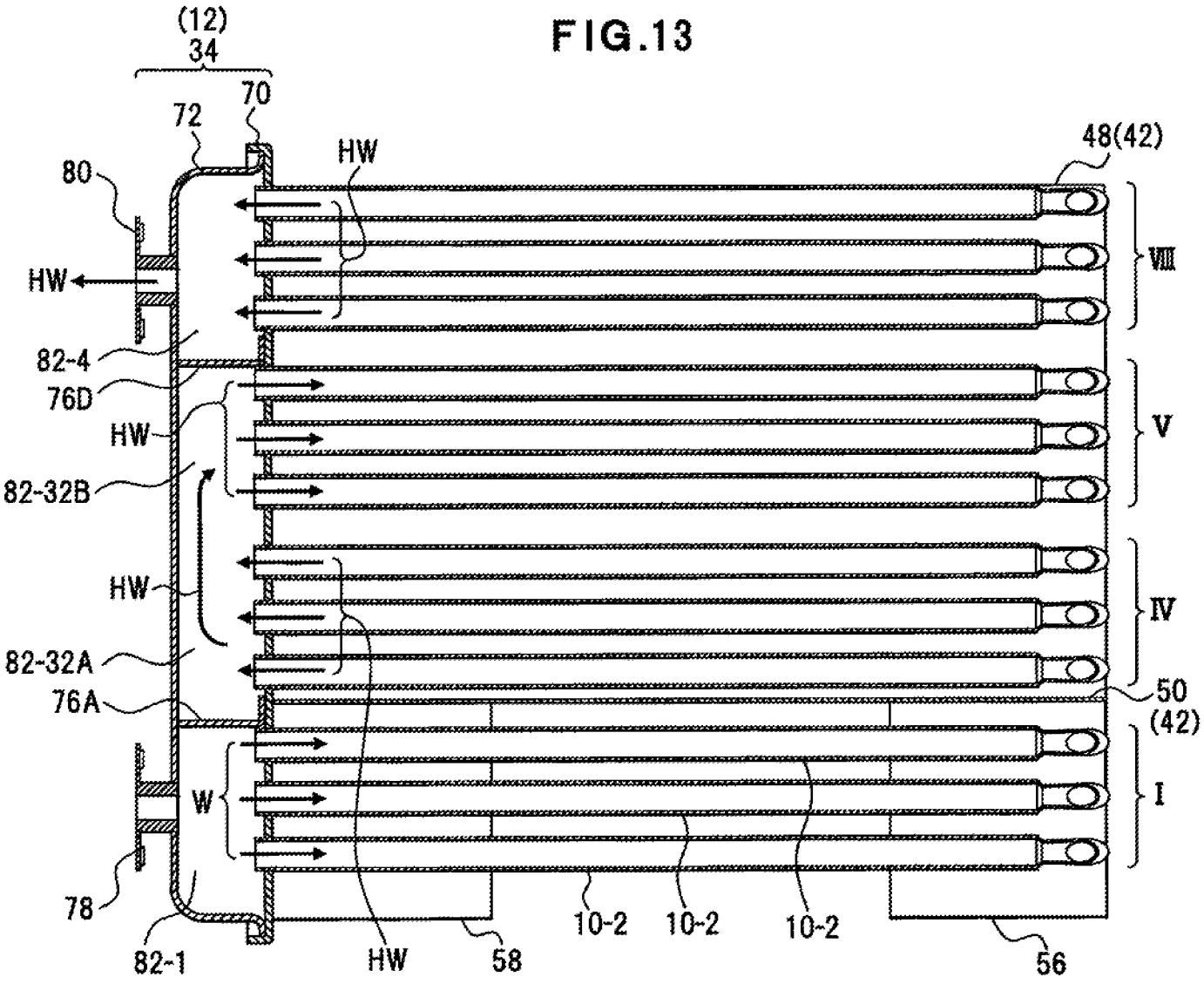
FIG. 13 is a view showing a cross section taken along line E-E of a configuration example of FIG. 8.
Figure 14:
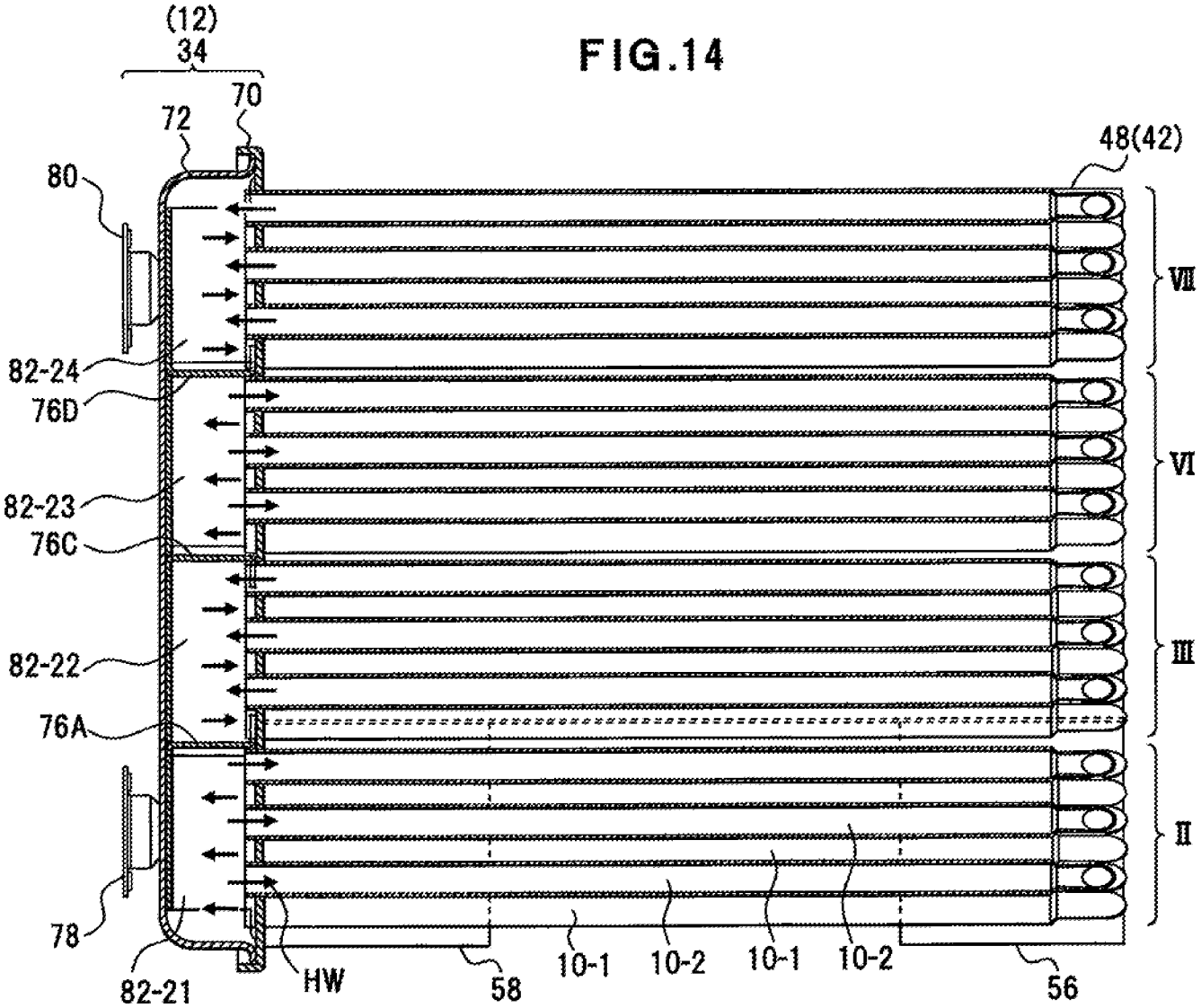
FIG. 14 is a view showing a cross section taken along line F-F of the configuration example of FIG. 8.
Figure 15:
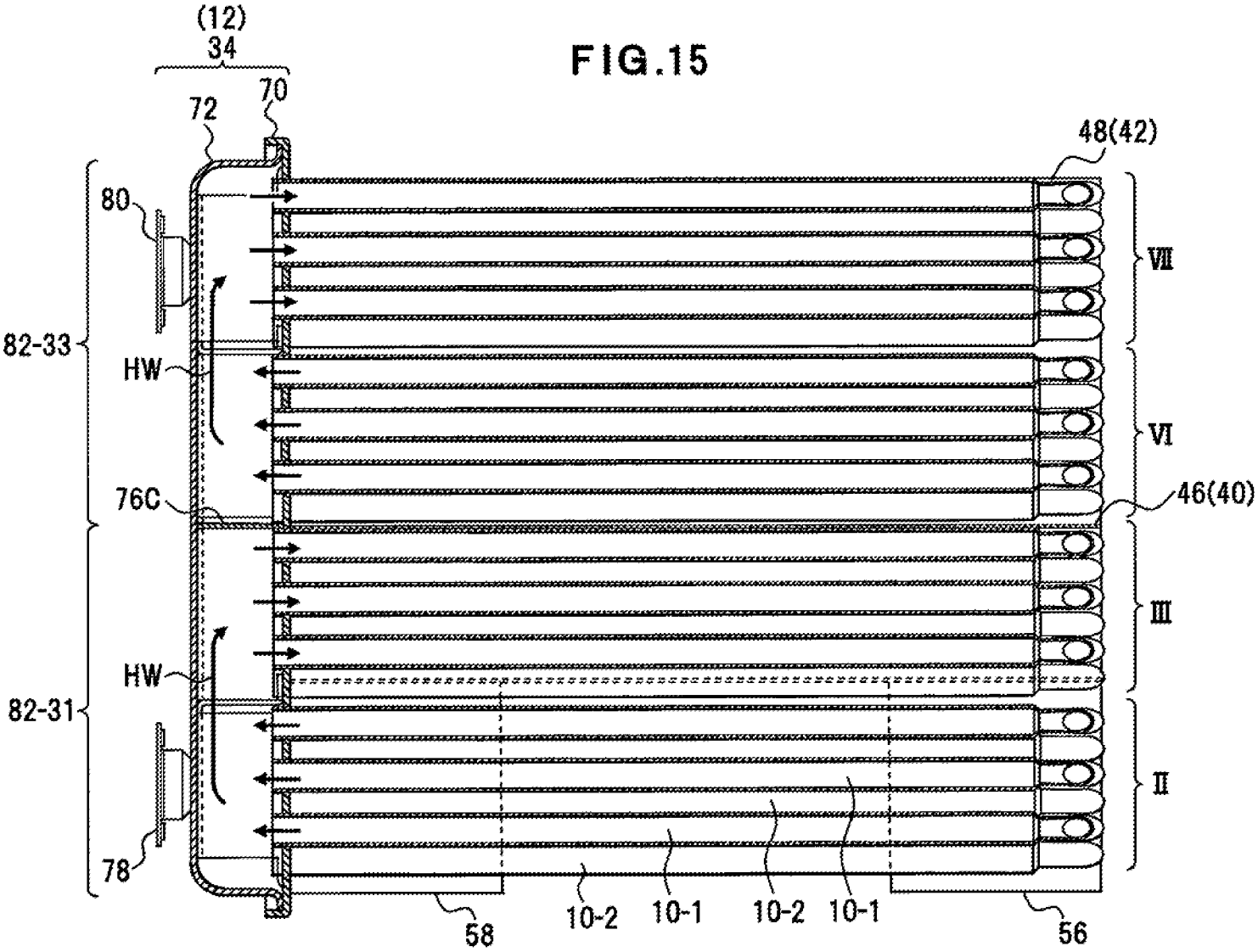
FIG. 15 is a view showing a cross section taken along line G-G of the configuration example of FIG. 8.

FIG. 9 shows a cross section taken along line A-A of the configuration example of FIG. 7. FIG. 10 shows a cross section taken along line B-B of the configuration example of FIG. 7. FIG. 11 shows a cross section taken along line C-C of the configuration example of FIG. 7. FIG. 12 shows a cross section taken along line D-D of the configuration example of FIG. 7. FIG. 13 shows a cross section taken along line E-E of the configuration example of FIG. 8. FIG. 14 shows a cross section taken along line F-F of the configuration example of FIG. 8. FIG. 15 shows a cross section taken along line G-G of the configuration example of FIG. 8.

For example, as shown in FIG. 9, water W flowing from the inlet port 78 into the header portion 34 is led from the inlet chamber 82-1 through the heat exchange pipe group I, the passing chamber 82-21 and the heat exchange pipe group II to the turn-back chamber 82-31. The heat exchange pipe groups I, II exchange heat between water W or hot water HW passing through the interior of the heat exchange pipe groups I, II and exhaust gas EG flowing from top to bottom in the heat exchange portion 32. This exhaust gas EG flows toward the discharge portion 54.

As shown in FIG. 10, hot water HW arriving at the turn-back chamber 82-31 is led through the heat exchange pipe group III, the passing chamber 82-22 and the heat exchange pipe group IV to the turn-back chamber 82-32. The heat exchange pipe groups III, IV exchange heat between hot water HW passing through the interior of the heat exchange pipe groups III, IV and exhaust gas EG rising from the cut-off plate 48 side. This exhaust gas EG, for example, passes through the interior of a narrow flow route formed between confronting surfaces of the first and second regulation plate 46, 50, and flows in a turbulent state as a result of increase in the flow velocity of the exhaust gas EG and bend of the flow direction of exhaust gas EG passing the peripheries of the first regulation plate 46.

As shown in FIG. 11, hot water HW arriving at the turn-back chamber 82-32 is led through the heat exchange pipe group V, the passing chamber 82-23 and the heat exchange pipe group VI to the turn-back chamber 82-33. The heat exchange pipe groups V, VI exchange heat between hot water HW passing through the interior of the heat exchange pipe groups V, VI and exhaust gas EG flowing downward from the opening 52 side.

As shown in FIG. 12, hot water HW arriving at the turn-back chamber 82-33 is led through the heat exchange pipe group VII, the passing chamber 82-24 and the heat exchange pipe group VIII to the outlet chamber 82-4. The heat exchange pipe groups VII, VIII exchange heat between hot water HW passing through the interior of the heat exchange pipe groups VII, VIII and exhaust gas EG flowing downward from the opening 52 side. Hot water HW arriving at the outlet chamber 82-4 is then discharged through the outlet port 80 to the exterior of the header portion 34. Exhaust gas EG in the vicinity of the heat exchange pipe groups V, VI, VII, VIII flows in from the opening 52 of the heat exchange portion 32 and flows down toward the cut-off plate 48.

For example, as shown in FIG. 13, hot water HW led to the turn-back chamber 82-32 changes its flow direction from the heat exchange pipe group IV within the chamber, and is led to the inlet of the heat exchange pipe group V adjacent to the heat exchange pipe group IV.

As shown in FIG. 14, the passing chambers 82-21, 82-23 lead hot water HW flowing into the passing chambers 82-21, 82-23 through the connected conduit portions 10-1, toward the conduit portions 10-2 of another heat exchange pipes 10. The passing chambers 82-22, 82-24 lead hot water HW flowing into the passing chambers 82-22, 82-24 through the connected conduit portions 10-2, toward the conduit portions 10-1 of another heat exchange pipes 10.

For example, as shown in FIG. 15, hot water HW led to the turn-back chamber 82-31 changes its flow direction from the heat exchange pipe group II within the chamber, and is led to the inlet of the heat exchange pipe group III adjacent to the heat exchange pipe group II. For example, as shown in FIG. 15, hot water HW led to the turn-back chamber 82-33 changes its flow direction from the heat exchange pipe group VI within the chamber, and is led to the inlet of the heat exchange pipe group VII adjacent to the heat exchange pipe group VI.

[Relationship between Flow Direction of Fluid to Be Heated and Direction of Flow of Exhaust Gas EG]

Figure 16:
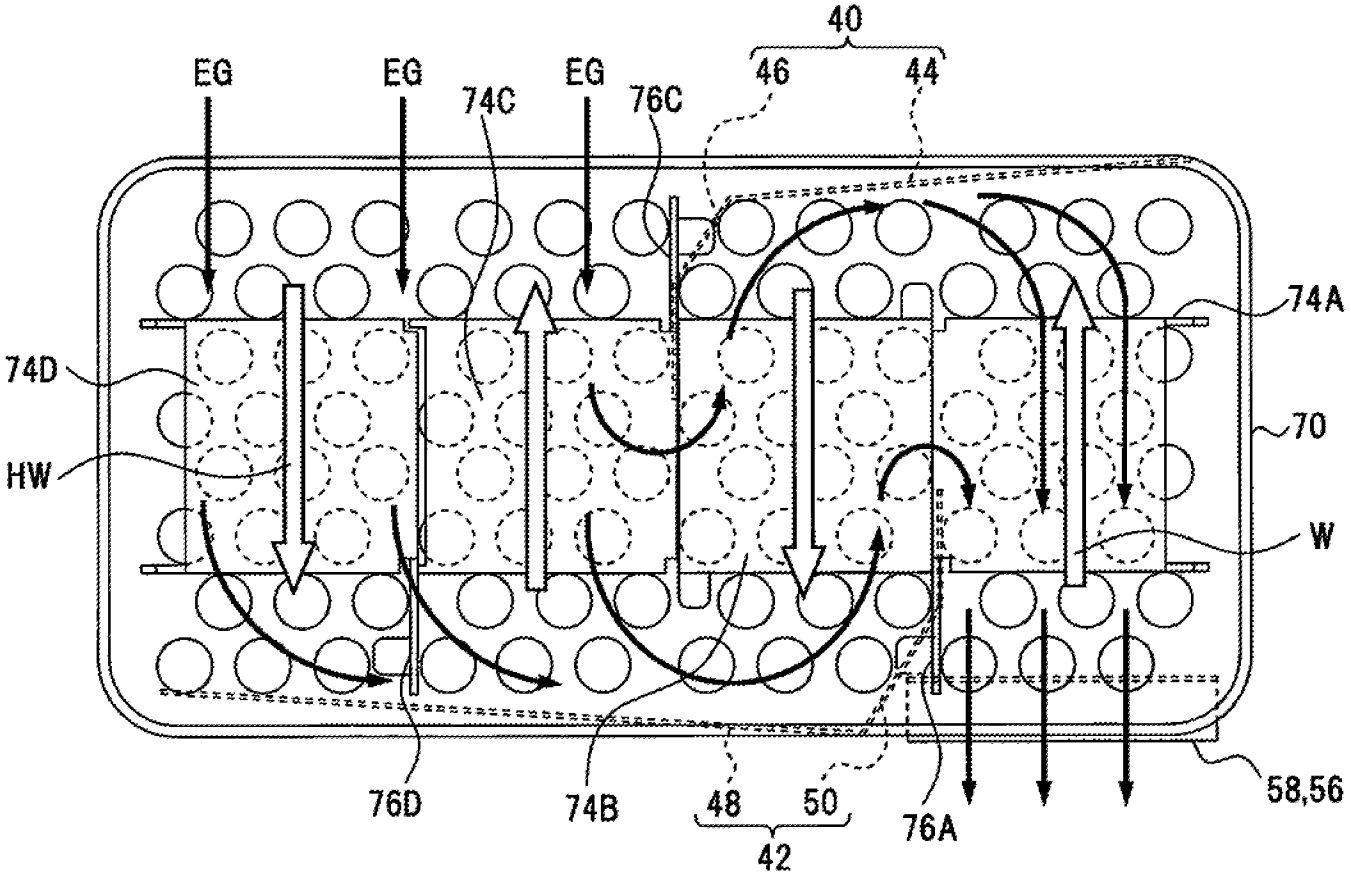
FIG. 16 is a view showing flow directions of a fluid to be heated and flow directions of exhaust gas in a heat exchange portion.

For example, as shown in FIG. 16, the heat exchanging unit 30 is set such that flow of the fluid to be heated led by the heat exchange pipes 10 and the chambers in the header portion 34 confronts flow of exhaust gas EG led by the wind direction plates 40, 42 disposed in the heat exchange portion 32. That is, the flow route of exhaust gas EG in the heat exchange portion 32 is associated with the flow route of the fluid to be heated in the header portion 34 such that flow of exhaust gas EG confronts flow of the fluid to be heated. Specifically, at least parts of the first and second regulation plates 46, 50 of the wind direction plates 40, 42 arranged in the heat exchange portion 32 are disposed at positions confronting parts of the partition walls of the chambers, which are in the header portion 34, across the heat exchange pipe mounting panel 70 as the boundary wall between the heat exchange portion 32 and the header portion 34. The heat exchanging unit 30 then exchanges heat between a low-temperature fluid to be heated flowing on the passage upstream side and exhaust gas EG flowing on the flow route downstream side, whose temperature has fallen as a result of heat exchange with the plurality of heat exchange pipe groups. The heat exchanging unit 30 exchanges heat between a fluid to be heated flowing on the passage downstream side, whose temperature has risen as a result of passing through the plurality of heat exchange pipe groups, and a high-temperature exhaust gas EG flowing from the heat source toward the flow route upstream side.

By setting the directions of flows of the fluid to be heated and exhaust gas EG in this manner, the states of temperature of the fluid to be heated and exhaust gas EG can be set so as to ensure an efficient heat exchange.

[External Configuration Example of Heat Exchanging Unit 30]

Figure 17:
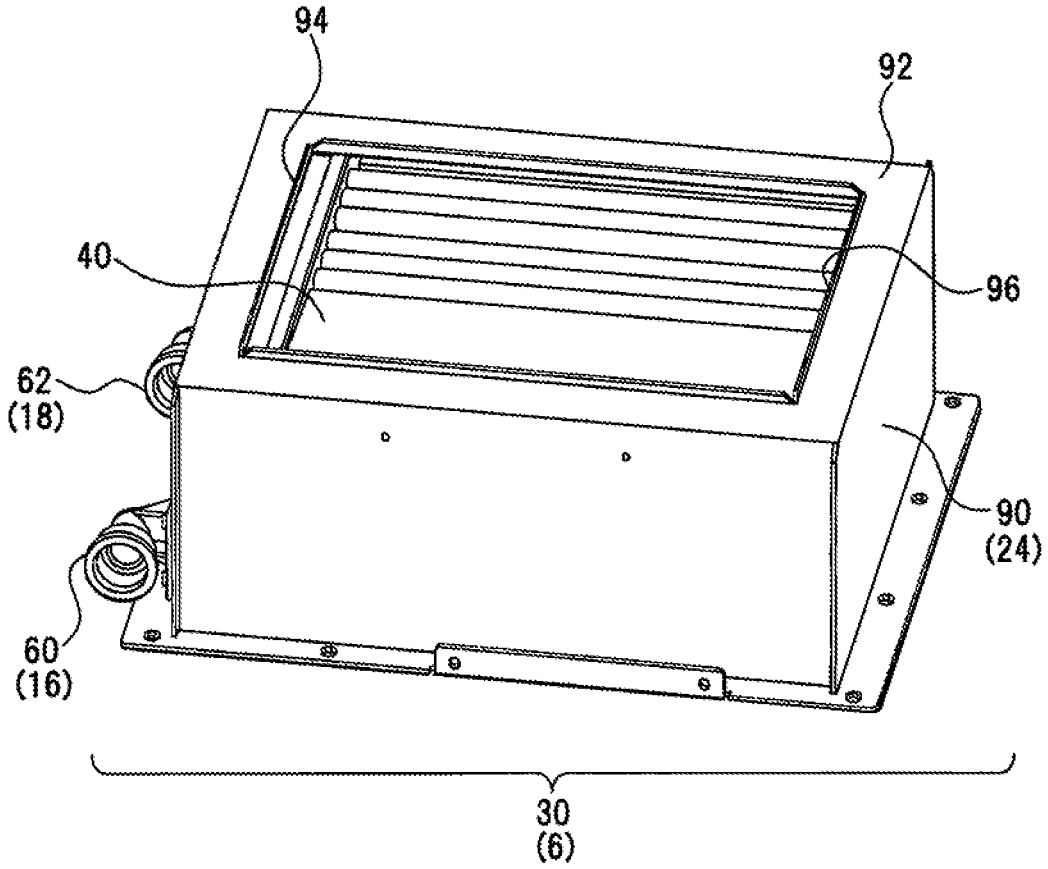
FIG. 17 is a view showing an external configuration example of the heat exchanging unit.

For example, as shown in FIG. 17, the heat exchanging unit 30 is covered by an exterior member for allowing received exhaust gas EG to flow along the flow route in the heat exchange portion 32. This exterior member includes e.g. lateral walls 90 covering the peripheries of the heat exchange portion 32 and the header portion 34, and a top plate 92 covering the upper surface side of the heat exchange portion 32 and the header portion 34. The lateral walls 90 surround at least lateral surfaces of the heat exchange portion 32 to inhibit exhaust gas EG from flowing out from portions other than the discharge portion 54. The lateral walls 90 may not be disposed on the surface side where the header portion 34 is disposed, and the water supply portion 60 and the water discharge portion 62 of the header portion 34 may be exposed to the exterior.

The top plate 92 includes e.g. a cut-off portion 94 covering the upper surface portion of the header portion 34, and an opening 96 for receiving exhaust gas EG flowing from a heat source (not shown) or from another heat exchanging unit.

The lateral walls 90 and the top plate 92 may be formed integrally, for example. A separate member may be integral with or connected to the heat exchanging unit 30 by a fixing member (not shown).

Effects of Second Embodiment

According to such a configuration, the following effects can be expected.

(1) The wind direction plate 40 reduces the opening size of a portion for receiving the exhaust gas EG, and causes a variation of the flow velocity and the flow pressure of exhaust gas EG flowing into the heat exchange portion 32, so that the state of flow of exhaust gas EG results in a turbulent flow. Exhaust gas EG can then be in contact with the peripheries of the heat exchange pipes 10 for an elongated period of time, improving the heat exchange efficiency.

(2) The first and second regulation plates 46, 50 arranged in the heat exchange portion 32 change the cross-sectional area of the flow route through which exhaust gas EG flows, to form a flow route that bends flowing exhaust gas EG at a predetermined angle. Flow of exhaust gas EG can then be changed into a turbulent flow, so that exhaust gas EG can easily come into contact with surfaces of the heat exchange pipes, thereby prolonging the time of contact of exhaust gas EG with the peripheries of the heat exchange pipes 10. Therefore, the heat exchangeability between exhaust gas EG and the fluid to be heated can be improved.

(3) Since flow of exhaust gas EG flowing through the interior of the heat exchange portion 32 confronts or substantially confronts flow of the fluid to be heated flowing through the heat exchange pipes 10 via the header portion 34, heat of exhaust gas EG can efficiently be transferred by heat exchange to the fluid to be heated. That is, heat exchange on the upstream side of the flow route for the exhaust gas EG is carried out between hot water HW having a high temperature as a result of plural times of heat exchange in the heat exchange portion 32 and exhaust gas EG having a high temperature with the number of times of heat exchange being zero or small. This can impede heat exchange between high-temperature hot water HW and low-temperature exhaust gas E, or can prevent the heat exchange efficiency from lowering.

(4) Due to the arrangement of the cut-off plate 44 of the wind direction plate 40 and the cut-off plate 48 of the wind direction plate 42, exhaust gas EG cannot diffuse in the heat exchange portion 32. The cut-off plates 44, 48 are tilted at a predetermined angle with respect to the direction of flow of exhaust gas EG, and can then lead exhaust gas EG in a certain direction, rendering it possible to prevent exhaust gas EG from remaining in the flow route.

Third Embodiment

Figure 18:
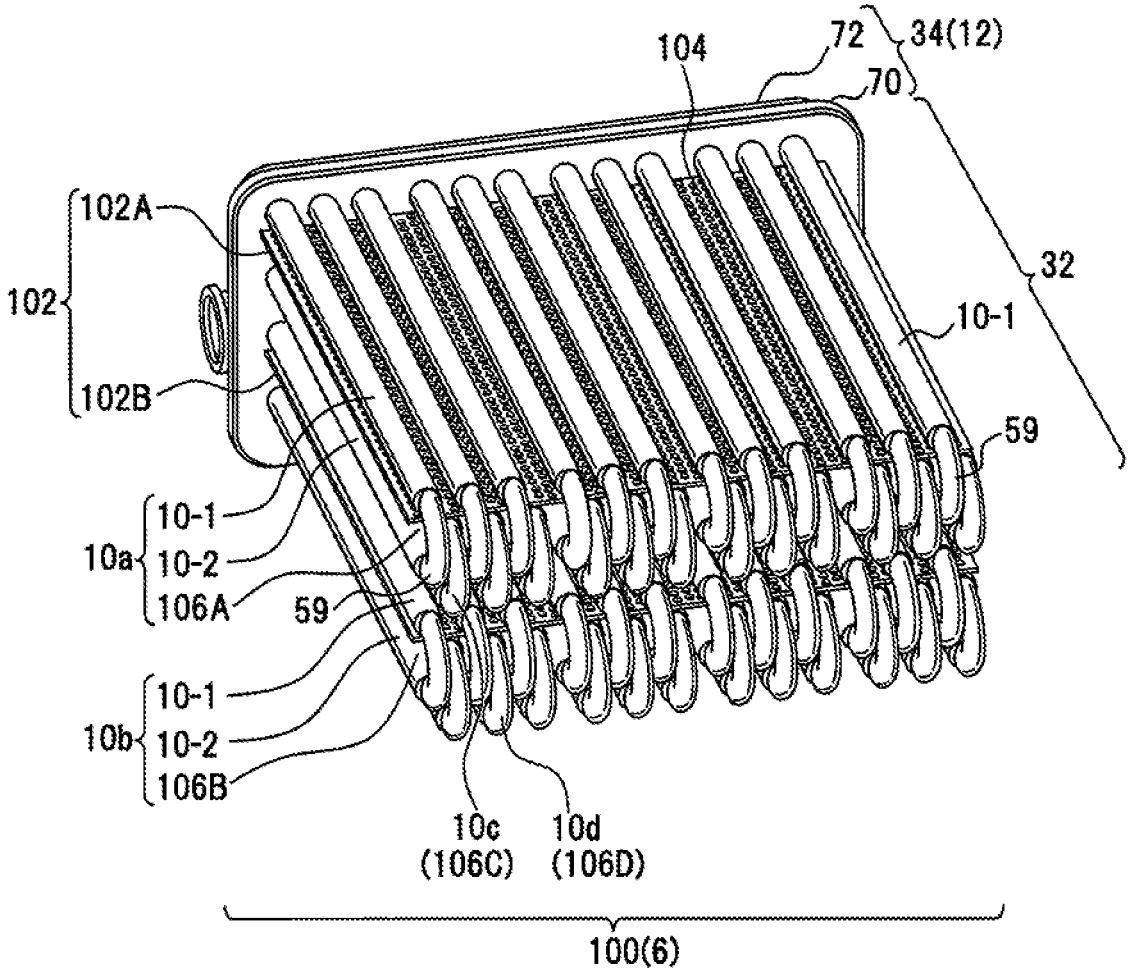
FIG. 18 is a view showing a configuration example of a heat exchanging unit according to a third embodiment.
Figure 19:
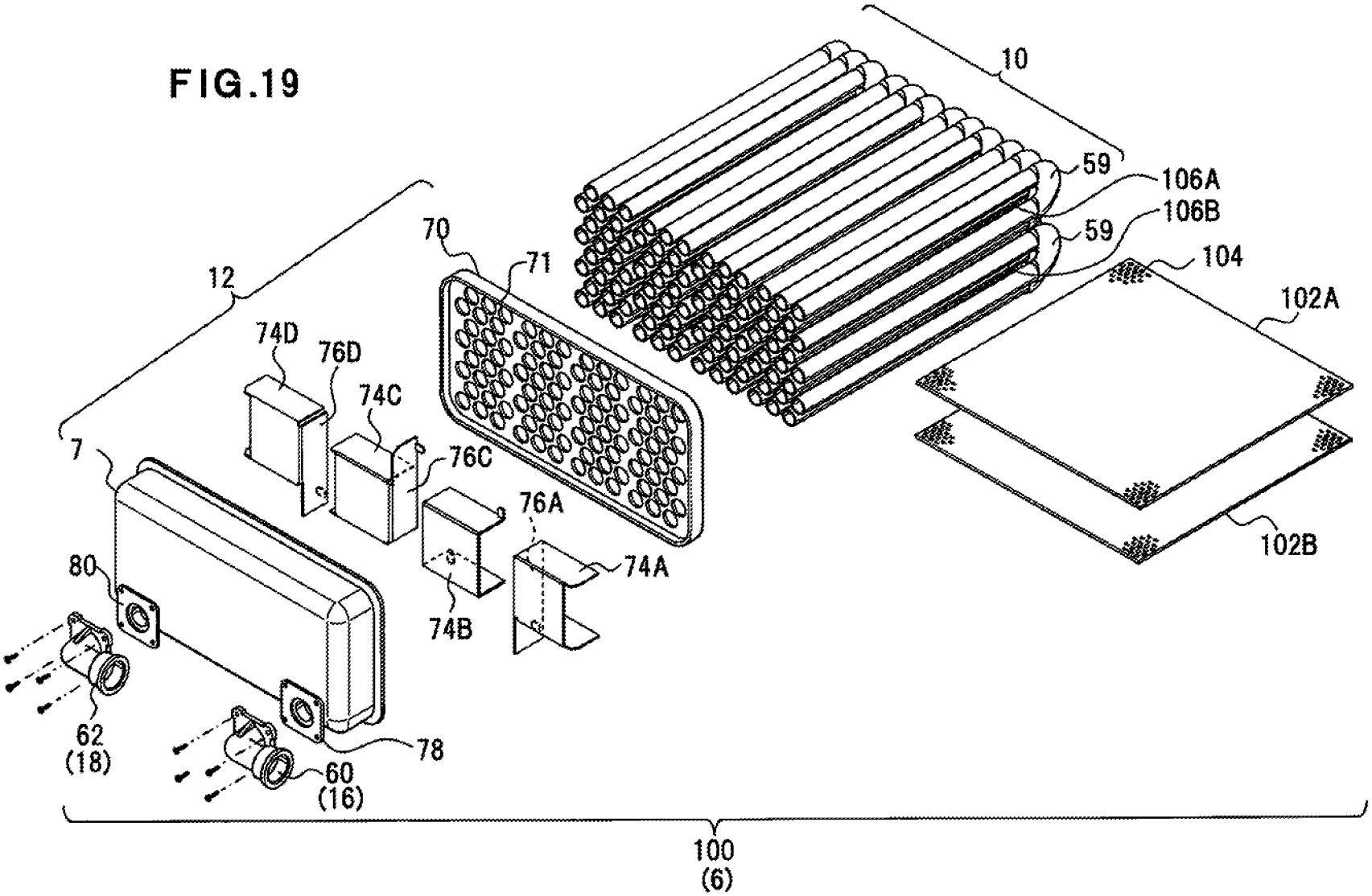
FIG. 19 is an exploded perspective view showing a configuration example of the heat exchanging unit.

FIG. 18 shows a configuration example of a heat exchanging unit 100 according to a third embodiment. FIG. 19 shows an exploded perspective view of the configuration example of the heat exchanging unit. The configuration shown in FIGS. 18 and 19 is an example, and this disclosure is not limited to such a configuration. In this embodiment, constituent elements that are the same as those of the above embodiments are designated as the same reference numerals and will not again be described.

For example, as shown in FIG. 18, the heat exchanging unit 100 includes ventilation plates 102A, 102B regulating the flow rate of exhaust gas EG flowing into the heat exchange portion 32. The ventilation plates 102A, 102B are an example of the flow changing portion of this disclosure and are formed from a metal plate, for example. The ventilation plates 102A, 102B have a plurality of vents 104 formed on flat surfaces of the ventilation plates 102A, 102B.

The heat exchange portion 32 includes the heat exchange pipes 10. The heat exchange pipes 10 are, for example, each bent in a U-shape, and are arranged in two (upper and lower) stages. The heat exchange pipes 10 are arrayed such that each heat exchange pipe 10 is disposed above or below by a predetermined amount with respect to other heat exchange pipes 10 adjacent transversely. That is, the heat exchange pipes 10 include, as a minimum of combination of a plurality of adjacent heat exchange pipes 10, for example, a first heat exchange pipe 10*a*, a second heat exchange pipe 10*b*, a third heat exchange pipe 10*c*, and a fourth heat exchange pipe 10*d*, with the first heat exchange pipe 10*a* and the second heat exchange pipe 10*b* being mutually arranged in a vertical direction, with the third heat exchange pipe 10*c* being disposed transversely adjacent to but downward apart a predetermined distance from the first heat exchange pipe 10*a*, with the fourth heat exchange pipe 10*d* being disposed transversely adjacent to but downward apart a predetermined distance from the second heat exchange pipe 10*b*.

The heat exchange pipes 10*a*-10*d* include the respective turn-back portions 59. The turn-back portions 59 form respective space portions 106A-106D between the respective conduit portions 10-1, 10-2. The heat exchange pipes 10*a*, the heat exchange pipes 10*b*, the heat exchange pipes 10*c* and the heat exchange pipes 10*d* are juxtaposed parallel to each other in the heat exchange portion 32.

The ventilation plates 102A, 102B are, for example, arranged so as to penetrate the respective space portions 106 of the adjacent heat exchange pipes 10 that are level with each other. For example, as shown in FIG. 18, the ventilation plate 102A is disposed in the space portions 106A of the heat exchange pipes 10*a* and above or on the heat exchange pipes 10*c*. The ventilation plate 102B is disposed in the space portions 106B of the heat exchange pipes 10*b* and above or on the heat exchange pipes 10*d*.

[About Ventilation Plates 102A, 102B]

Figure 20A:
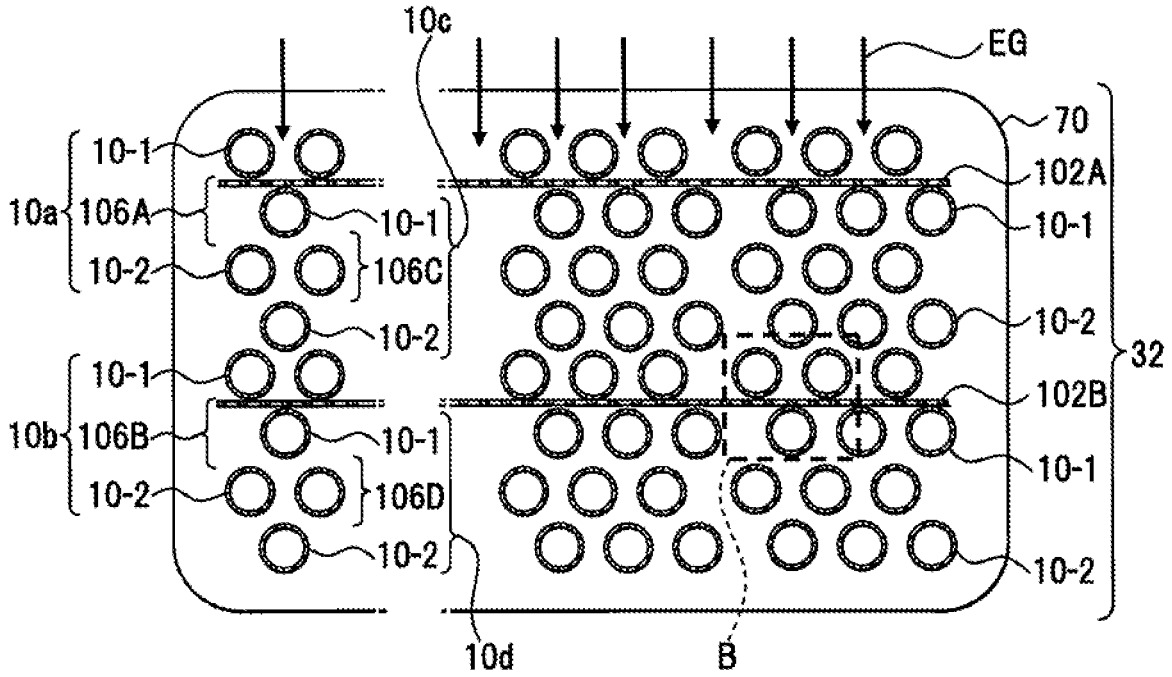
FIG. 20A is a view showing a state example of flow of exhaust gas through the heat exchange portion.

For example, as shown in FIG. 20A, the ventilation plate 102A is disposed on the flow route through which exhaust gas EG flows, with its flat surface being directed toward this flow route. For this reason, the ventilation plate 102A allows exhaust gas EG flowing into the heat exchange portion 32 to pass through the vents 104 and flow toward its rear surface side. The ventilation plate 102B is, on the surface side thereof, brought into contact with exhaust gas EG flowing in the heat exchange portion 32, to allow exhaust gas EG to flow through the vents 104 toward the discharge portion 54 downstream of the heat exchange portion 32.

Figure 20B:
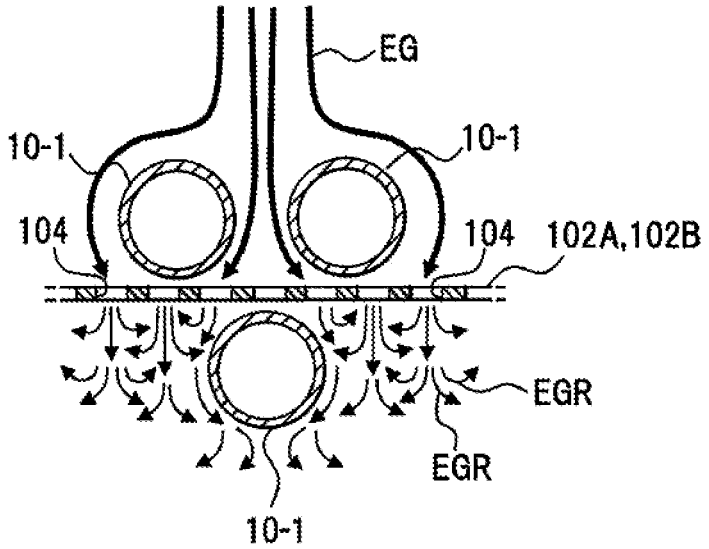
FIG. 20B is a partially enlarged view of FIG. 20A.

For example, as shown in FIG. 20B, the ventilation plates 102A, 102B are, on their front surface side, brought into contact with exhaust gas EG flowing on the upstream side. Exhaust gas EG flows in a certain direction with a stable flow state such as a laminar flow state or a state approximating thereto before exhaust gas EG is brought into contact with the ventilation plates 102A, 102B. However, apart of exhaust gas EG arriving at the ventilation plates 102A, 102B is reflected by the ventilation plates 102A, 102B or flows along the surfaces of the ventilation plates 102A, 102B to remain. Another part of exhaust gas EG enters the narrow vents 104 to pass through the ventilation plates 102A, 102B.

For example, since the flow path diameter of exhaust gas EG is narrowed by the vents 104, exhaust gas EG passing through the ventilation plates 102A, 102B are subjected to the action of Venturi effect. For this reason, the flow velocity of exhaust gas EG passing through the ventilation plates 102A, 102B varies to a great extent, so that flow of exhaust gas EG turns to an exhaust flow EGR in a diffused state at the time of departure from the vents 104. Accordingly, flow of exhaust gas EG goes to a turbulent state as a result of passing through the ventilation plates 102A, 102B.

The arranged ventilation plates 102A, 102B may be, for example, in contact with a part of the conduit portion 10-1, or may be apart from the conduit portion 10-1 with a gap formed therebetween. Front surface portions of the ventilation plates 102A, 102B may be, for example, heated by remaining exhaust gas EG, and may transfer heat to the conduit portion 10-1 in contact. In the case that the ventilation plates 102A, 102B are separate from the conduit portion 10-1, exhaust gas EG flows into a gap between one of the ventilation plates 102A, 102B and the conduit portion 10-1 to change the state of flow of exhaust gas EG, thereby enabling the state of contact of exhaust gas EG with the conduit portion 10-1 to be kept longer.

Effects of Third Embodiment

According to such a configuration, the following effects are obtained.

(1) By disposing the ventilation plate 102 on the exhaust flow path in the heat exchange portion 32, the state of flow of exhaust gas EG can be changed. It is therefore possible to prolong the time during which exhaust gas EG remains in the heat exchange portion 32, to thereby enhance the efficiency of heat exchange with the fluid to be heated.

(2) By forming a plurality of small-diameter exhaust flow paths in the heat exchange portion 32, flow of exhaust gas EG is subdivided and exhaust gas EG can flow widely by the diffusion effect of exhaust gas EG passing through the vents 104, with the result that deviation of temperature in the heat exchange portion 32 can be prevented.

(3) By disposing the ventilation plate 102, exhaust gas EG passing through the vents 104 is diffused, and exhaust gas EG remains by the action of the plate surface. By virtue of this diffusion and remaining of exhaust gas EG, the time of contact between the conduit portion 10-1 and the exhaust gas EG can be prolonged, so that the heat exchange efficiency can be enhanced.

(4) By inserting the ventilation plate into gaps on the heat exchange pipes 10, flow of exhaust gas EG can be changed, so that the heat exchange efficiency can be improved by fewer in number of parts. The ventilation plate 102 can be added to the existing heat exchange portion 32, so that its assembling can be simplified.

Fourth Embodiment

Figure 21:
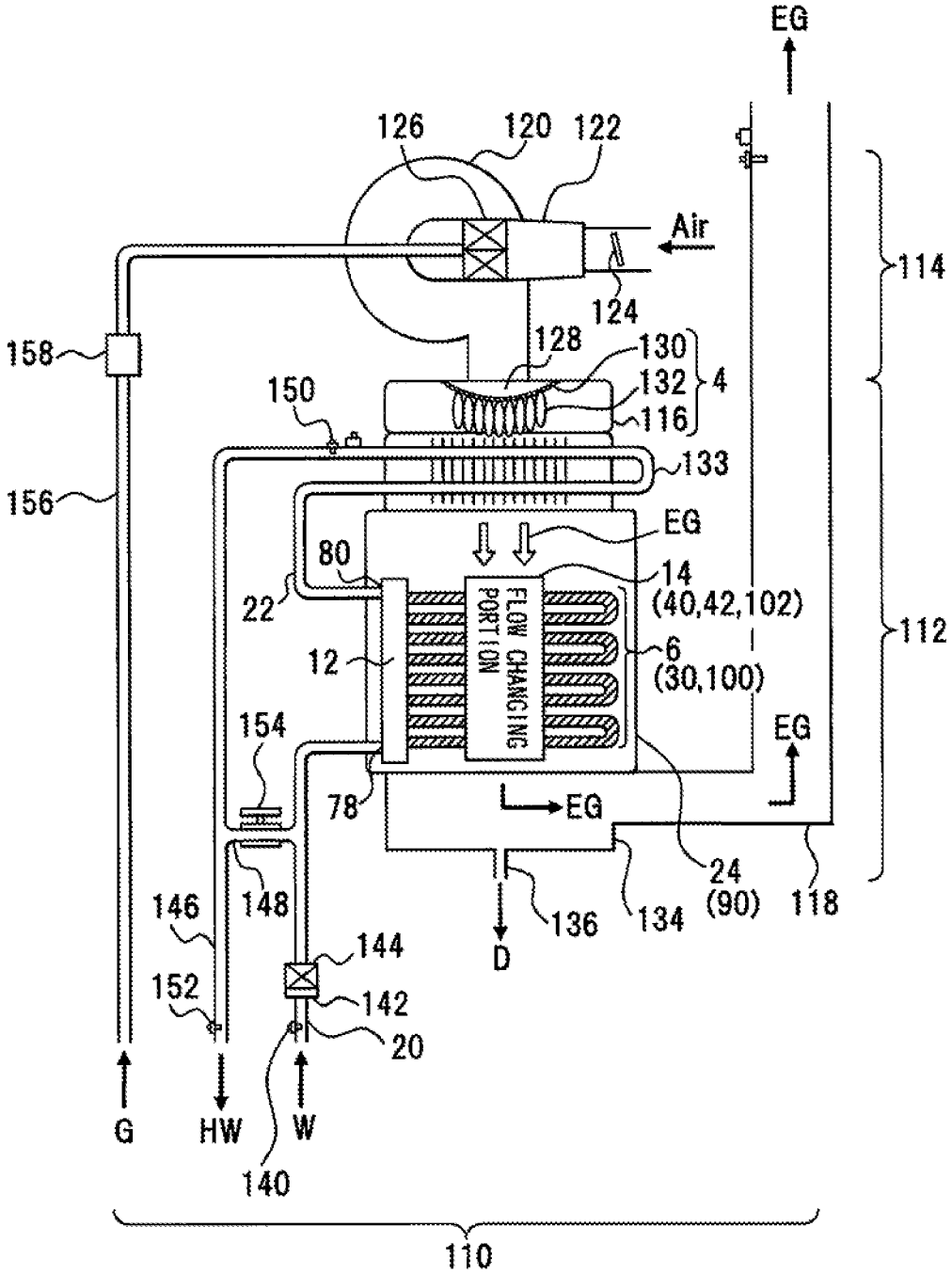
FIG. 21 is a view showing a configuration example of a hot water supply system according to a fourth embodiment.

FIG. 21 shows a configuration example of a hot water supply system according to a fourth embodiment. The configuration shown in FIG. 21 is an example and this disclosure is not limited to such a configuration.

[About Hot Water Supply System 110]

For example, as shown in FIG. 21, this hot water supply system 110 includes a heat exchanging apparatus 112, a mixing unit 114, a water supply pipe 20 supplying water W, as an example of a fluid to be heated, to the heat exchanging apparatus 112, and a hot water outlet pipe 146 supplying hot water HW heated by the heat exchanging apparatus 112.

This heat exchanging apparatus 112, for example, includes the above described heat exchanging unit 6, which includes the flow changing portion 14 on the flow route of exhaust gas EG, as a secondary heat exchanger; a combustion housing 116; and an exhaust unit 118. The flow changing portion 14 is, for example, the exhaust flow path formed by the wind direction plates 40, 42 in the heat exchange portion 32, as described above, and may include a single or a plurality of ventilation plates 102A, 102B limiting a part of flow of exhaust gas EG.

[About Mixing Unit 114]

The mixing unit 114 includes an air supply fan 120 and a Venturi portion 122. By the Venturi function, the Venturi portion 122 mixes fuel gas G and air fed to this Venturi portion 122, to make an air-fuel mixture GM. By the rotation of the air supply fan 120 and by the degree of opening of an air adjustment valve 124, the amount of supply of air flowing into the Venturi portion 122 is adjusted. Depending on this air supply amount, the degree of opening of a gas adjustment valve 126 is adjusted, so that fuel gas G is introduced into the Venturi portion 122.

[About Heat Exchanging Apparatus 112]

The burner 4 includes, for example, the combustion housing 116 and a metal knit burner 128, the combustion housing 116 allowing exhaust gas EG generated by the metal knit burner 128 to flow. The metal knit burner 128 is an example of burning means having a metal knit 130 on its combustion surface. The air-fuel mixture GM flows from the back of the metal knit burner 128 toward the combustion surface for a flame 132 to occur on or under the surface of the metal knit 130, and exhaust gas EG is then generated.

The heat exchanging apparatus 112 includes a primary heat exchanger 133. The primary heat exchanger 133 is disposed on the upstream side in the flow of exhaust gas EG generated by the burner 4 and transfers, by heat exchange, mainly the sensible heat of the exhaust gas EG to water W.

The secondary heat exchanger in the form of the heat exchanging unit 6 is disposed downstream of the primary heat exchanger 133 in the flow of exhaust gas EG and transfers, by heat exchange, mainly the latent heat of exhaust gas EG after heat exchange to water W by the primary heat exchange 133.

Exhaust gas EG passing through the heat exchanging unit 6 is released through the exhaust unit 118 into the outside air. The exhaust unit 118 has a drain receiver 134 on the underside of the heat exchanging unit 6. Drain generated in the heat exchanging unit 6 is collected in the drain receiver 134 and is drained from a drain port 136 to the exterior.

Water W is led from the water supply pipe 20 to the inlet port 78 of the heat exchanging unit 6. The outlet port 80 of the heat exchanging unit 6 is connected to the hot water supply pipe 22 allowing hot water HW to flow to the primary heat exchanger 133. The hot water supply pipe 22 is an example of a conduit that allows hot water HW heat-exchanged in the heat exchanging unit 6 to pass therethrough. That is, after having been heated in the heat exchanging unit 6, hot water HW is again heated by heat of exhaust gas EG in the primary heat exchanger 133.

Although in this example the heat exchanging unit 6 is used as the secondary heat exchanger, this heat exchanging unit 6 may be used as the primary heat exchanger 133.

Although the hot water supply system 110 of this embodiment includes the combustion housing 116 disposed on the upper side, so that exhaust gas flows downward, the hot water supply system 110 is not limited thereto. The hot water supply system 110 may include the combustion housing 116 disposed on the lower side, so that exhaust gas EG generated by the burner 4 can flow upward.

In addition, the hot water supply system 110 includes e.g. a temperature sensor 140, a water flow sensor 142, and a water supply valve 144 on the water supply pipe 20. The temperature sensor 140 detects the temperature of water W. The water flow sensor 142 detects flow of water entering the water supply pipe 20. The water supply valve 144 is used for adjustment of the water supply amount.

The hot water outlet pipe 146 is connected to the outlet of the primary heat exchanger 133. The hot water outlet pipe 146 connects via a bypass pipe 148 to the water supply pipe 20. The hot water outlet pipe 146 includes a temperature sensor 150 and a mixing temperature sensor 152. The temperature sensor 150 detects the temperature of hot water HW at the outlet of the primary heat exchanger 133. The mixing temperature sensor 152 detects the temperature of a mixture of hot water HW and water W. The bypass pipe 148 has a bypass valve 154. This bypass valve 154 adjusts the amount of mixing of water W relative to hot water HW by the adjustment of the degree of opening.

The mixing unit 114 is connected to a gas supply pipe 156, and fuel gas G is fed through the gas supply pipe 156 to the mixing unit 114. The gas supply pipe 156 is provided with a gas valve 158. The gas valve 158 adjusts the flow rate of fuel gas G flowing from the gas supply pipe 156 into the mixing unit 114.

The hot water supply system 110 includes a control portion such as a computer. The control portion controls hot water supply. The control portion includes e.g. a processor, a memory portion, and an input/output portion (I/O). The memory portion stores e.g. an operation control program such as a hot water supply control program. The I/O is connected to the air adjustment valve 124, the gas adjustment valve 126, the temperature sensors 140, 150, the water flow sensor 142, the water supply valve 144, the mixing temperature sensor 152, the bypass valve 154, and the gas valve 158, and outputs control instructions based on hot water supply control processing.

Effects of Fourth Embodiment

According to this embodiment, the following effects can be expected.

(1) The heat exchanging unit 6 having the flow changing portion 14 is used as the secondary heat exchanger, so that the latent heat of exhaust gas EG can be recovered more efficiently.

Other Embodiments

With regard to the embodiments as set forth hereinabove, variants thereof will be enumerated below.

(1) Although in the above embodiments the heat exchanging unit 6 includes the wind direction plates 40, 42 or the ventilation plate 102 as the flow changing portion 14, the heat exchanging unit 6 is not limited thereto. The heat exchanging unit 6 may include, for example, both types of plates: the wind direction plates 40, 42 and the ventilation plates 102. Otherwise, the heat exchanging unit 6 may include e.g. either one of the wind direction plates 40, 42 and the ventilation plates 102.

(2) Although in the above embodiments the heat exchanging unit 6 includes, in total, two ventilation plates 102 being arranged in the vicinity of the vertically juxtaposed heat exchange pipes 10*a*, 10*b*, respectively, the heat exchanging unit 6 is not limited thereto. For example, the heat exchanging unit 6 may include a single ventilation plate 102 or may include three or more ventilation plates 102. In the case that the heat exchanging unit 6 includes three or more ventilation plates 102, the ventilation plates 102 are inserted into any three or more space portions 106A, 106B, 106C, 106D of the adjacent heat exchange pipes 10, for example.

(3) Although in the above embodiments the ventilation plate 102 is a single flat plate having a length equal to or shorter than the width of the heat exchange portion 32, the ventilation plate 102 is not limited thereto. For example, a plurality of flat ventilation plates 102 narrower than the transverse width of the heat exchange portion 32 may be juxtaposed. Specifically, the plurality of ventilation plates 102 may be arranged in dense at the central portion of the flow route through which exhaust gas EG easily flows, whereas they may be spaced apart from one another in the vicinity of the lateral walls. Hence, flow of exhaust gas in the heat exchange portion 32 can be adjusted.

(4) The vents 104 formed in the ventilation plates 102 may not have opening diameters equal to one another and may not be arranged evenly. For example, in view of the flowability of exhaust gas EG in the heat exchange portion 32, the size or the arrangement pattern of the vents 104 may be adjusted. Furthermore, for example, in the case that the combination of at least one of the ventilation plates 102 and at least one of the wind direction plates 40, 42 forms a flow route through which exhaust gas EG flows, the formation position and the size of the vents 104 may be set so as to conform to the flow route formed by at least one of the wind direction plates 40, 42.

(5) Although in the above embodiments the arrangement position of the wind direction plates 40, 42 corresponds to formation position of the chambers in the header portion 34, the arrangement position of the wind direction plates 40, 42 is not limited thereto. The wind direction plates 40, 42 may form a flow route such that the heat exchange pipe connecting to the first chamber, for example, allows exhaust gas EG to circulate multiple times.

Aspects of Embodiments

According to an aspect of the embodiments described above, a heat exchanging unit exchanges heat between a fluid to be heated and exhaust gas. The heat exchanging unit includes a heat exchange portion, a header portion, and a flow changing portion. The heat exchange portion includes a heat exchange pipe allowing the fluid to be heated to flow in the heat exchange pipe. The header portion is connected to the heat exchange pipe, the header portion allowing the fluid to be heated to flow from the header portion to the heat exchange pipe or from the heat exchange pipe to the header portion. The flow changing portion changes the state of flow of the exhaust gas introduced into the heat exchange portion.

In the above heat exchanging unit, the flow changing portion may include a wind direction plate that changes the direction of flow of the exhaust gas flowing in the heat exchange portion. The exhaust gas flowing in the heat exchange portion may contact with the wind direction plate or may flow along the wind direction plate, thereby turning the exhaust gas into a turbulent flow.

In the above heat exchanging unit, the heat exchange portion may include an exhaust flow path formed from a plurality of wind direction plates including the wind direction plate. The exhaust flow path may bend flow of the exhaust gas at right angles, at approximate right angles, or at angles more than right angles, so that the exhaust gas flows.

In the above heat exchanging unit, the heat exchange pipe may be one of a plurality of heat exchange pipes. The header portion may include a partition wall vertically extending in the header portion, and the partition wall may partition the header portion into a plurality of areas each including a predetermined number of the plurality of heat exchange pipes connected to the header portion. The wind direction plate may be disposed so as to confront a part of the partition wall across a boundary wall of the header portion to which the plurality of heat exchange pipes are connected.

In the above heat exchanging unit, the heat exchange portion may include an opening and a discharge portion, the exhaust gas may be introduced through the opening into the heat exchange portion, and the discharge portion may discharge the exhaust gas after heat exchange from the heat exchange portion. The flow changing portion may regulate the amount of opening of either one of or both of the opening and the discharge portion.

In the above heat exchanging unit, the flow changing portion may include a ventilation plate having a plurality of vents through which the exhaust gas passes. The flow changing portion may change the flow velocity of the exhaust gas passing through the vents to turn the flow of the exhaust gas into a turbulent flow.

In the above heat exchanging unit, the heat exchange pipe may be one of a plurality of heat exchange pipes, each heat exchange pipe may have a turn-back portion and turned-back conduits, and the plurality of heat exchange pipes may be arrayed in parallel with or in substantially parallel with the other. The ventilation plate may be disposed between the turned-back conduits of the plurality of heat exchange pipes.

In the above heat exchanging unit, a part of another heat exchange pipes may enter into a space between the turned-back conduits of each heat exchange pipe, and a space between adjacent heat exchange pipes may be set less than the diameter of the heat exchange pipes.

In the above heat exchanging unit, the ventilation plate may be a single ventilation plate or one of a plurality of ventilation plates, and the single ventilation plate or the plurality of ventilation plates may be disposed along the direction of flow of the exhaust gas in the heat exchange portion.

According to another aspect of the embodiments described above, a heat exchanging apparatus includes a housing allowing exhaust gas to flow in the housing, and a heat exchanging unit disposed in the housing. The heat exchanging unit includes a heat exchange portion, a header portion and a flow changing portion. The heat exchange portion includes a heat exchange pipe allowing a fluid to be heated to flow in the heat exchange pipe to exchange heat between the fluid to be heated and the exhaust gas. The header portion is connected to the heat exchange pipe to allow the fluid to be heated to flow from the header portion to the heat exchange pipe or from the heat exchange pipe to the header portion. The flow changing portion changes the state of flow of the exhaust gas introduced into the heat exchange portion.

The above heat exchanging apparatus may further include a burner disposed on an upper side or a lower side of the heat exchanging unit. The heat exchange pipe may come into contact with the exhaust gas in a direction intersecting the flowing direction of the fluid to be heated.

According to yet another aspect of the embodiments described above, a hot water supply system includes a burner that burns fuel gas to generate exhaust gas, a housing allowing the exhaust gas flows to flow, and a heat exchanging unit disposed in the housing. The heat exchanging unit includes a heat exchange portion, a header portion, and a flow changing portion. The heat exchange portion includes a heat exchange pipe allowing a fluid to be heated to flow in the heat exchange pipe to exchange heat between the fluid to be heated and the exhaust gas. The header portion is connected to the heat exchange pipe to allow the fluid to be heated to flow from the header portion to the heat exchange pipe or from the heat exchange pipe to the header portion. The flow changing portion changes the state of flow of the exhaust gas introduced into the heat exchange portion.

According to the above described embodiments, any one of the following effects can be expected.

(1) The flowing state of exhaust gas flowing in the heat exchange portion is varied, and the degree of contact and the efficiency of heat exchange of exhaust gas with the heat exchange pipes can be improved.

(2) The heat exchange efficiency between exhaust gas and the fluid to be heated is improved as a result of a change in the flowing state of exhaust gas, and the exhaust loss of the heat exchanging unit can be prevented from increasing, while keeping the flowability of exhaust gas in the heat exchange portion.

(3) Due to the improved heat exchange efficiency of exhaust gas, responsivity of the hot water temperature to the hot water supply request can be enhanced.

The most preferred embodiments, etc. of this disclosure have hereinabove been described. This disclosure is not limited to the above descriptions. Various modifications or alterations could be made by those skilled in the art, based on the gist of disclosure defined in the claims or disclosed in DETAILED DESCRIPTION OF THE INVENTION. It is natural that such modifications or alterations are encompassed in the scope of this disclosure.

By changing the state of flow of exhaust gas EG flowing in the heat exchange portion into the turbulent state, this disclosure is useful in that it can prolong the time of contact of exhaust gas EG with the peripheral surfaces of the heat exchange pipes, to improve the recovery efficiency of heat in exhaust gas EG.

The invention claimed is:

1. A heat exchanging unit for exchanging heat between a fluid to be heated and exhaust gas, the heat exchanging unit comprising:

a heat exchange portion including a plurality of heat exchange pipes allowing the fluid to be heated to flow in the plurality of heat exchange pipes;

a header portion connected to the plurality of heat exchange pipes, the header portion allowing the fluid to be heated to flow from the header portion to the plurality of heat exchange pipes or from the plurality of heat exchange pipes to the header portion;

first and second wind direction plates that change the state of flow of the exhaust gas introduced into the heat exchange portion; and third and fourth regulation plates placed in the heat exchange portion, the third and fourth regulation plates being adjacent to the second wind direction plate, wherein the heat exchange portion includes an opening and a discharge portion, the opening introduces the exhaust gas into the heat exchange portion, and the discharge portion discharges the exhaust gas after heat exchange from the heat exchange portion, wherein the first wind direction plate includes a first cut-off plate and a first regulation plate linked with the first cut-off plate, the first cut-off plate is disposed on a side of the opening of the heat exchange portion to regulate an opening amount of the opening, and the first regulation plate is disposed from the side of the opening toward an interior of the heat exchange portion, wherein the second wind direction plate includes a second cut-off plate and a second regulation plate linked with the second cut-off plate, the second cut-off plate is disposed on a side of the discharge portion of the heat exchange portion to regulate an opening amount of the discharge portion, and the second regulation plate is disposed from the side of the discharge portion toward the interior of the heat exchange portion, wherein the third and fourth regulation plates restrict an opening area of the discharge portion of the heat exchange portion, such that the exhaust gas is collected toward the discharge portion, wherein the plurality of heat exchange pipes include a first heat exchange pipe on a side of the opening of the heat exchange portion, a second heat exchange pipe on a side of the first cut-off plate, a third heat exchange pipe on a side of the discharge portion of the heat exchange portion, and a fourth heat exchange pipe on a side of the second cut-off plate, wherein the first regulation plate is partially disposed between the first heat exchange pipe and the second heat exchange pipe, wherein the second regulation plate is partially disposed between the third heat exchange pipe and the fourth heat exchange pipe, and wherein the first and second wind direction plates form a meandering exhaust flow path for the exhaust gas in the heat exchange portion.

2. The heat exchanging unit of claim 1, wherein the first and second wind direction plates change the direction of flow of the exhaust gas flowing in the heat exchange portion for the exhaust gas flowing in the heat exchange portion to contact with the first and second wind direction plates or to flow along the first and second wind direction plates, thereby turning the exhaust gas into a turbulent flow.

3. The heat exchanging unit of claim 1, wherein the exhaust flow path bends flow of the exhaust gas at right angles, at approximate right angles, or at angles more than right angles, so that the exhaust gas flows.

4. The heat exchanging unit of claim 1, wherein the header portion includes a partition wall vertically extending in the header portion, and the partition wall partitions the header portion into a plurality of areas each including a predetermined number of the plurality of heat exchange pipes connected to the header portion, and wherein the first and second wind direction plates are disposed so as to confront a part of the partition wall across a boundary wall of the header portion to which the plurality of heat exchange pipes are connected.

5. A heat exchanging unit for exchanging heat between a fluid to be heated and exhaust gas, the heat exchanging unit comprising:

a heat exchange portion including a plurality of heat exchange pipes allowing the fluid to be heated to flow in the plurality of heat exchange pipes;

a header portion connected to the plurality of heat exchange pipes, the header portion allowing the fluid to be heated to flow from the header portion to the plurality of heat exchange pipes or from the plurality of heat exchange pipes to the header portion;

first and second wind direction plates that change the state of flow of the exhaust gas introduced into the heat exchange portion; and a ventilation plate having a plurality of vents through which the exhaust gas passes, wherein the heat exchange portion includes an opening and a discharge portion, the opening introduces the exhaust gas into the heat exchange portion, and the discharge portion discharges the exhaust gas after heat exchange from the heat exchange portion, wherein the first wind direction plate includes a first cut-off plate and a first regulation plate linked with the first cut-off plate, the first cut-off plate is disposed on a side of the opening of the heat exchange portion to regulate an opening amount of the opening, and the first regulation plate is disposed from the side of the opening toward an interior of the heat exchange portion, wherein the second wind direction plate includes a second cut-off plate and a second regulation plate linked with the second cut-off plate, the second cut-off plate is disposed on a side of the discharge portion of the heat exchange portion to regulate an opening amount of the discharge portion, and the second regulation plate is disposed from the side of the discharge portion toward the interior of the heat exchange portion, wherein the plurality of heat exchange pipes include a first heat exchange pipe on a side of the opening of the heat exchange portion, a second heat exchange pipe on a side of the first cut-off plate, a third heat exchange pipe on a side of the discharge portion of the heat exchange portion, and a fourth heat exchange pipe on a side of the second cut-off plate, wherein the first regulation plate is partially disposed between the first heat exchange pipe and the second heat exchange pipe, wherein the second regulation plate is partially disposed between the third heat exchange pipe and the fourth heat exchange pipe, and wherein the first and second wind direction plates form a meandering exhaust flow path for the exhaust gas in the heat exchange portion, wherein the ventilation plate changes the flow velocity of the exhaust gas passing through the vents to turn the flow of the exhaust gas into a turbulent flow.

6. The heat exchanging unit of claim 5, wherein each heat exchange pipe has a turn-back portion and turned-back conduits, and the plurality of heat exchange pipes are arrayed in parallel with or in substantially parallel with the other, and wherein the ventilation plate is disposed between the turned-back conduits of the plurality of heat exchange pipes.

7. The heat exchanging unit of claim 6, wherein a part of another heat exchange pipe of the plurality of heat exchange pipes enters into a space between the turned-back conduits of each heat exchange pipe of the plurality of heat exchange pipes, and a space between adjacent heat exchange pipes of the plurality of heat exchange pipes is set less than the diameter of the heat exchange pipes of the plurality of heat exchange pipes.

8. The heat exchanging unit of claim 5, wherein the ventilation plate is a single ventilation plate or one of a plurality of ventilation plates, the single ventilation plate or the plurality of ventilation plates being disposed along the direction of flow of the exhaust gas in the heat exchange portion.

9. A heat exchanging apparatus comprising:

a housing allowing exhaust gas to flow in the housing; and a heat exchanging unit disposed in the housing, the heat exchanging unit including a heat exchange portion, a header portion, first and second wind direction plates, and third and fourth regulation plates, wherein the heat exchange portion includes a plurality of heat exchange pipes allowing a fluid to be heated to flow in the plurality of heat exchange pipes to exchange heat between the fluid to be heated and the exhaust gas, wherein the header portion is connected to the plurality of heat exchange pipes to allow the fluid to be heated to flow from the header portion to the plurality of heat exchange pipes or from the plurality of heat exchange pipes to the header portion, wherein the first and second wind direction plates change the state of flow of the exhaust gas introduced into the heat exchange portion, wherein the third and fourth regulation plates are placed in the heat exchange portion, and are adjacent to the second wind direction plate, wherein the heat exchange portion includes an opening and a discharge portion, the opening introduces the exhaust gas into the heat exchange portion, and the discharge portion discharges the exhaust gas after heat exchange from the heat exchange portion, wherein the first wind direction plate includes a first cut-off plate and a first regulation plate linked with the first cut-off plate, the first cut-off plate is disposed on a side of the opening of the heat exchange portion to regulate an opening amount of the opening, and the first regulation plate is disposed from the side of the opening toward an interior of the heat exchange portion, wherein the second wind direction plate includes a second cut-off plate and a second regulation plate linked with the second cut-off plate, the second cut-off plate is disposed on a side of the discharge portion of the heat exchange portion to regulate an opening amount of the discharge portion, and the second regulation plate is disposed from the side of the discharge portion toward the interior of the heat exchange portion, wherein the third and fourth regulation plates restrict an opening area of the discharge portion of the heat exchange portion, such that the exhaust gas is collected toward the discharge portion, wherein the plurality of heat exchange pipes include a first heat exchange pipe on a side of the opening of the heat exchange portion, a second heat exchange pipe on a side of the first cut-off plate, a third heat exchange pipe on a side of the discharge portion of the heat exchange portion, and a fourth heat exchange pipe on a side of the second cut-off plate, wherein the first regulation plate is partially disposed between the first heat exchange pipe and the second heat exchange pipe, wherein the second regulation plate is partially disposed between the third heat exchange pipe and the fourth heat exchange pipe, and wherein the first and second wind direction plates form a meandering exhaust flow path for the exhaust gas in the heat exchange portion.

10. The heat exchanging apparatus of claim 9, further comprising:

a burner disposed on an upper side or a lower side of the heat exchanging unit, wherein the plurality of heat exchange pipes comes into contact with the exhaust gas in a direction intersecting the flowing direction of the fluid to be heated.

11. A hot water supply system comprising:

a burner that burns fuel gas to generate exhaust gas;

a housing allowing the exhaust gas to flow; and a heat exchanging unit disposed in the housing, the heat exchanging unit including a heat exchange portion, a header portion, first and second wind direction plates, and third and fourth regulation plates, wherein the heat exchange portion includes a plurality of heat exchange pipes allowing a fluid to be heated to flow in the plurality of heat exchange pipes to exchange heat between the fluid to be heated and the exhaust gas, wherein the header portion is connected to the plurality of heat exchange pipes to allow the fluid to be heated to flow from the header portion to the plurality of heat exchange pipes or from the plurality of heat exchange pipes to the header portion, wherein the first and second wind direction plates change the state of flow of the exhaust gas introduced into the heat exchange portion, wherein the third and fourth regulation plates are placed in the heat exchange portion, and are adjacent to the second wind direction plate, wherein the heat exchange portion includes an opening and a discharge portion, the opening introduces the exhaust gas into the heat exchange portion, and the discharge portion discharges the exhaust gas after heat exchange from the heat exchange portion, wherein the first wind direction plate includes a first cut-off plate and a first regulation plate linked with the first cut-off plate, the first cut-off plate is disposed on a side of the opening of the heat exchange portion to regulate an opening amount of the opening, and the first regulation plate is disposed from the side of the opening toward an interior of the heat exchange portion, wherein the second wind direction plate includes a second cut-off plate and a second regulation plate linked with the second cut-off plate, the second cut-off plate is disposed on a side of the discharge portion of the heat exchange portion to regulate an opening amount of the discharge portion, and the second regulation plate is disposed from the side of the discharge portion toward the interior of the heat exchange portion, wherein the third and fourth regulation plates restrict an opening area of the discharge portion of the heat exchange portion, such that the exhaust gas is collected toward the discharge portion, wherein the plurality of heat exchange pipes include a first heat exchange pipe on a side of the opening of the heat exchange portion, a second heat exchange pipe on a side of the first cut-off plate, a third heat exchange pipe on a side of the discharge portion of the heat exchange portion, and a fourth heat exchange pipe on a side of the second cut-off plate, wherein the first regulation plate is partially disposed between the first heat exchange pipe and the second heat exchange pipe, wherein the second regulation plate is partially disposed between the third heat exchange pipe and the fourth heat exchange pipe, and wherein the first and second wind direction plates form a meandering exhaust flow path for the exhaust gas in the heat exchange portion.

12. The heat exchanging unit of claim 1, wherein the third and fourth regulation plates are tilted inward of the heat exchange portion.

13. The heat exchanging apparatus of claim 9, wherein the third and fourth regulation plates are tilted inward of the heat exchange portion.

14. The hot water supply system of claim 11, wherein the third and fourth regulation plates are tilted inward of the heat exchange portion.

* * * * *